US005858311A

United States Patent [19]

Bachtel

[11] Patent Number: 5,858,311

[45] Date of Patent: Jan. 12, 1999

[54] THERMOCOUPLE WELL ASSEMBLY WITH A SEALING COUPLING AND A METHOD FOR ELIMINATING LEAKS IN HYDROCONVERSION REACTORS WHILE CONTINUING TO HYDROPROCESS

[75] Inventor: Robert W. Bachtel, El Cerrito, Calif.

[73] Assignee: Chevron U.S.A. Inc., San Francisco, Calif.

[21] Appl. No.: 615,377

[22] Filed: Mar. 14, 1996

[51] Int. Cl.[6] ..... G05D 23/00; F16L 35/00; F16L 55/00; F21R 19/00

[52] U.S. Cl. ..... 422/109; 122/511; 285/104; 285/109; 285/138; 285/139; 285/331; 174/77 R

[58] Field of Search ..... 422/109; 122/511; 285/104, 109, 138, 139, 331; 174/77 R

[56] References Cited

U.S. PATENT DOCUMENTS

| | | | |
|---|---|---|---|
| 4,028,139 | 6/1977 | Smith et al. | 136/230 |
| 4,064,756 | 12/1977 | MacLean et al. | 73/349 |
| 4,137,768 | 2/1979 | Tushie et al. | 73/343 |
| 4,331,170 | 5/1982 | Wendell | 137/15 |
| 4,332,272 | 6/1982 | Wendell | 137/318 |
| 4,334,334 | 6/1982 | Wendell | 15/236 |
| 4,510,343 | 4/1985 | Sivyer | 136/242 |
| 5,302,113 | 4/1994 | Eichelberger et al. | 431/155 |
| 5,492,617 | 2/1996 | Trimble et al. | 208/148 |
| 5,589,057 | 12/1996 | Trimble et al. | 208/148 |
| 5,599,440 | 2/1997 | Stangeland et al. | 208/148 |

FOREIGN PATENT DOCUMENTS

| | | |
|---|---|---|
| 1045963 | 1/1979 | Canada . |
| 1303094 | 6/1992 | Canada . |
| 2063164 | 9/1993 | Canada . |
| WO 91/01359 | 2/1991 | WIPO . |

*Primary Examiner*—Patrick D. Niland
*Attorney, Agent, or Firm*—Alan W. Klaassen

[57] ABSTRACT

A thermowell assembly and method which allows for arresting leakage in the case a thermowell begins to leak in a hydroprocessing process without having to shut down a flow of a hydrocarbon feed stream through a hydroconversion reaction zone in the hydroprocessing process. The thermowell assembly comprises a first hollow sleeve section which supports a thermowell member, a ferrule sealing member which engages the first hollow sleeve section, a second generally cup-shaped second sleeve section wherethrough a thermocouple member slidably passes, and an outer sleeve member for maintaining the union of the first sleeve section, the ferrule sealing member, and the second sleeve section. The method comprises severing and/or removing the thermocouple member from the commenced-leaking thermowell member and placing a high pressure cap over an aperture left vacant by the thermocouple member to seal-off the leaking thermowell member from the atmosphere.

10 Claims, 17 Drawing Sheets

THERMOCOUPLE WELL ASSEMBLY WITH A SEALING COUPLING AND A METHOD FOR ELIMINATING LEAKS IN HYDROCONVERSION REACTORS WHILE CONTINUING TO HYDROPROCESS

BACKGROUND OF THE INVENTION

1. Field of the Invention

The present invention broadly relates to a pipe union assembly. More specifically, the present invention provides for a thermocouple well assembly having a thermocouple and a sealing coupling, and a method for hydroprocessing a hydrocarbon feed stream in a hydroconversion reaction zone that communicates with a thermowell member of a thermocouple well assembly. In the event that the thermowell member begins to leak hydrocarbon gas(es) and/or hydrocarbon(s) from the hydroconversion reaction zone, the present invention provides an apparatus and method that eliminates the leak(s) without having to shut down the flow of the hydrocarbon feed stream through the hydroconversion reaction zone.

2. Description of the Prior Art

Conventional practice in hydroprocessing hydrocarbon feed streams through hydroconversion reaction zones includes making temperature measurements to preclude thermal overloads. Temperature measurements in a hydroconversion reaction zone contained within a hydroconversion reactor are taken with thermocouples which are inserted in thermowells that penetrate a cylindrical wall of the hydroconversion reactor and thermally communicate with the hydroconversion reaction zone.

Thermowells are typically manufactured of relatively thin metallic material(s). Corrosion on the thin material(s) of the thermowells can cause leakage of the thermowells, which necessitates a premature shutdown of the hydroconversion reactor, as no means is presently available for temporarily stopping a leak from a leaking thermowell without having to totally shutdown the hydroconversion reactor. Since an unanticipated shutdown of a hydroconversion reactor zone is costly and time-consuming, it is desirable to continue operation of the hydroconversion reactor until the leaking thermowell can be repaired/replaced during a regularly scheduled shutdown. Some of the problems of avoiding unanticipated shutdowns associated with thermocouple/thermowell problems have been addressed in the prior art.

A patentability search was conducted and the following patents were found: U.S. Pat. No. 5,302,113 to Eichelberger et al; U.S. Pat. No. 4,510,343 to Sivyer; U.S. Pat. No. 4,137,768 to Tushie et al; U.S. Pat. No. 4,064,756 to MacLean et al; U.S. Pat. No. 4,334,334 to Wendell; U.S. Pat. No. 4,332,272 to Wendell; U.S. Pat. No. 4,331,170 to Wendell; Canadian Patent No. 1303094 to Chapman et al; Canadian Patent No. 1,045,963 to Krywitsky; and Canadian Patent Application No. 2,063,164 to Krywitsky.

U.S. Pat. No. 5,302,113 to Eichelberger et al. discloses a method for installing thermocouple on flare burner tip pilot assemblies from grade without discontinuing the operation of the flare.

U.S. Pat. No. 4,510,343 to Sivyer discloses a thermowell apparatus housing a removable thermocouple for sensing temperatures in a petrochemical furnace which includes a housing externally welded to a pipe or fitting and adapted to enclose a removable tip member of high alloy material and the removable thermocouple.

U.S. Pat. No. 4,137,768 to Tushie et al. teaches an adjustable depth tubular sheath thermowell assembly having a thermowell and a thermocouple and which permits changing the depth of extension of the well from its mounting into the environment to be sensed by utilizing compression fittings on the thermowell. The adjustable depth tubular sheath thermowell assembly to Tushie et al. also permits the replacement of the thermocouple.

U.S. Pat. No. 4,064,756 to MacLean et al. teaches a temperature sensitive instrument assembly (e.g., a combination thermowell/thermocouple) for being removably mounted in a flowline, vessel, or the like, and which includes a flange plate through which a hollow mounting tube is secured for supporting a temperature sensing element. The hollow mounting tube is provided with an opening or aperture for indirect impingement of the fluid flow through the vessel on the temperature sensing element. The fluid flow is diverted by a shield which is formed of or secured to the hollow mounting tube.

U.S. Pat. Nos. 4,334,334, 4,332,272, and 4,331,170, all to Wendell disclose a thermowell which is installed in a pipe or similar member without taking the member out of service by first welding an adapter to the surface of the member at the point where the thermowell is to be installed. Subsequently, a gate valve and a hot capping machine having a drill is connected to the adapter. A hole is drilled with the drill in the member through the open gate valve, and the drill is then withdrawn. The valve gate is closed and the withdrawn drill in the hot capping machine is replaced with the thermowell by opening the gate valve and subsequently installing the thermowell through the open gate valve.

Canadian Patent No. 1,303,094 to Chapman et al. teaches an improved pipe union comprising at least one hollow fitting member attachable to a pipe, or the like, and a sealing member also attachable to a pipe, or the like. The fitting member has a tapered ridge perimetrically formed around the end of the fitting member, which extends axially therefrom, and the sealing member has at least one perimetric tapered channel which complements the tapered ridge of the fitting member. The tapered ridge of the fitting member couples the perimetric tapered channel of the sealing member to form a fluid tight seal. In one embodiment, an external sleeve is employed to maintain the contact between the fitting member and the sealing member. The sleeve is coupled to the fitting member and the sealing member with set screws, threads, or the like.

Canadian Patent No. 1,045,963 to Krywitsky and Canadian Patent Application No. 2,063,164 by Krywitsky disclose a fastener for coupling at least two members. The fastener is generally cylindrical and has a generally C-shaped cross section and at least one barb member for engaging a surface of a member to be coupled. The fastener is generally employed in conjunction with a set screw, bolt head, or nut, or the like to serve as a counter-tamper measure. A set screw, bolt, nut, or the like is employed in the usual fashion with the fastener engaged to the set screw, bolt, nut, or the like and the member to which the screw, bolt, nut, or the like is engaged to prevent removal of the screw, bolt, nut, or the like. For example, in one embodiment the C-shaped fastener would be secured to a top face of a set screw and have at least one barb extending beyond the outer circumference of the set screw at an angle which allows rotation in a direction associated with tightening the set screw but which opposes rotation in a direction associated with loosening.

A review of the prior art reveals that the problem presented by a thermowell that begins to leak during operation of a hydroconversion reactor, and the problem of necessitating shutdown of the hydroconversion reactor to stop the leak of a leaking thermowell has yet to be addressed. Therefore, what is needed and what has been invented is effective apparatuses to prevent and/or suspend the leakage of a leaking thermowell during continual operation of a hydroconversion reactor without having to shutdown the hydroconversion reactor, and methods which facilitate rapid response to leakage of a leaking thermowell which commenced leaking during operation of a hydroconversion reactor.

SUMMARY OF THE INVENTION

The present invention broadly accomplishes its desired objects by providing a pipe union assembly comprising a generally hollow sleeve assembly having a first end with a tubular bore and a generally cup-shaped second end having a structure defining an end recess and a cylindrical opening communicating with the end recess and being generally axially aligned with the tubular bore of the first end of the generally hollow sleeve assembly. A bushing assembly is engaged in the second end recess of the generally cup-shaped second end of the sleeve assembly and has a bushing opening which is generally axially aligned with the cylindrical opening of the generally cup-shaped second end. The pipe union assembly further comprises a cylindrical well member defined by a generally solid well end and a generally open well end which is disposed in the tubular bore of the first end of the generally hollow sleeve assembly. The pipe union assembly may be adapted for receiving a generally cylindrical shaped member, such as a thermocouple, that passes through the cylindrical opening of the generally cup-shaped second end, through the bushing opening, and through the generally open well end of the cylindrical well member and into the cylindrical well member. The bushing assembly of the pipe union assembly is defined by a bushing body having a bushing body bore and a bushing body recess. The bushing assembly engages the end recess of the generally cup-shaped second end of the generally hollow sleeve assembly of the pipe union assembly such that a protruding bushing body section extends away from the end recess. The bushing assembly may additionally comprise a bushing sealing member which has a bushing sealing opening and which is disposed in the bushing body recess of the bushing assembly, and a bushing cap member having a bushing cap aperture and which engages the protruding bushing body section of the bushing assembly. The bushing body bore, the bushing sealing opening, and the bushing cap aperture are all generally aligned to essentially form the bushing opening of the bushing assembly.

The pipe union assembly of the present invention may be more particularly defined by a generally hollow first fitting member that has a first fitting bore terminating in a first annular tapered ridge. A ferrule sealing member is provided with a ferrule opening and a ferrule structure including a first annular tapered channel and a second annular tapered channel. The first annular tapered channel of the ferrule structure receives and lodges the first annular tapered ridge of the generally hollow first fitting member. The pipe union assembly is further more particularly defined by a second fitting member which is at least partially defined by the generally cup-shaped second end and which includes a second annular tapered ridge that lodges in the second annular tapered channel of the ferrule structure of the ferrule sealing member. Therefore, the ferrule sealing member is fitted between the first and second fitting members and has the ferrule opening and the ferrule structure including the first annular tapered channel and the second annular tapered channel, with the first annular tapered channel of the ferrule structure receiving and lodging the first annular tapered ridge of the generally hollow first fitting member with the second annular tapered channel of the ferrule structure receiving and lodging the second annular tapered ridge of the second fitting member. An outside sleeve member is engaged around the pipe union assembly to maintain the coupling together of the first fitting member, the ferrule sealing member and the second fitting such that the outside sleeve member engages the generally hollow first fitting member and the second fitting member to encapsulate the ferrule sealing member situated therebetween.

The present invention further accomplishes its desired objects by providing a thermowell assembly comprising a generally hollow sleeve assembly having a first end with a tubular bore and a generally cup-shaped second end having a structure defining an end recess and a cylindrical opening communicating with the end recess and being generally axially aligned with the tubular bore of the first end of the generally hollow sleeve assembly. A bushing assembly is engaged in the end recess of the generally cup-shaped second end of the sleeve assembly and has a bushing opening which is generally axially aligned with the cylindrical opening of the generally cup-shaped second end. A generally cylindrically shaped thermowell member having a generally solid thermowell end and a generally thermowell open end, is disposed in the tubular bore of the first end of the generally hollow sleeve assembly for slidably receiving a thermocouple member which passes through the cylindrical opening of the generally cup-shaped second end, through the bushing opening, and through the generally thermowell open end of the thermowell member and into the closed end of the thermowell member. The bushing assembly is defined by a bushing body having a bushing body bore and a bushing body recess.

The bushing assembly of the thermowell assembly engages the end recess of the generally cup-shaped second end of the generally hollow sleeve assembly so as to produce a protruding bushing body section extending away from the end recess. A bushing sealing member is provided as an element of the bushing assembly and includes a bushing sealing opening. The bushing sealing member is disposed in the bushing body recess of the bushing body. A bushing cap member with a bushing cap aperture is also provided as an element of the bushing assembly for being engaged to the protruding bushing body section of the bushing assembly. The bushing body bore, the bushing sealing opening, and the bushing cap aperture are all generally axially aligned to essentially form the bushing opening of the bushing assembly.

The generally hollow sleeve assembly of the thermowell assembly of the present invention includes a generally hollow first fitting member having a first fitting bore terminating in a first annular tapered ridge which is adapted for coupling to a ferrule sealing member that has a ferrule opening and a ferrule structure including a first annular tapered channel and a second annular tapered channel. The first annular tapered channel of the ferrule structure receives and lodges the first annular tapered ridge of the generally hollow first fitting member. The generally hollow sleeve assembly of the thermowell assembly of the present invention further includes a second fitting member which is at least partially defined by the generally cup-shaped second end and has a second annular tapered ridge that lodges in the second annular tapered channel of the ferrule structure of the ferrule sealing member. An outside sleeve member is engaged to the generally hollow first fitting member and to the second fitting member so as to encapsulate the ferrule sealing member.

The present invention further yet accomplishes its desired objects by broadly providing a reactor that employs the use of the thermowell assembly of the present invention. The reactor hydroprocess a hydrocarbon feed stream and has a generally cylindrical reactor wall containing a hydroconversion reaction zone including a bed of catalyst wherethrough a hydrocarbon feed stream flows. The generally hollow sleeve assembly of the thermowell assembly for the present invention is supported by the generally cylindrical reactor wall of the reactor such that the generally solid thermowell end of the thermowell assembly extends into the hydroconversion reaction zone.

The present invention still further accomplishes its desired objects by broadly providing a method for hydroprocessing a hydrocarbon feed stream that is flowing through a hydroconversion reaction zone having a bed of catalyst comprising the steps of:

(a) providing in an atmosphere a reactor having a generally cylindrical reactor wall containing a hydroconversion reaction zone including a bed of catalyst;

(b) providing a thermowell assembly having a generally hollow sleeve assembly, a thermowell member supported by the generally hollow sleeve assembly, and a thermocouple member supported by the generally hollow sleeve assembly and extending into the thermowell member;

(c) supporting the thermowell assembly of step (b) with the generally cylindrical reactor wall of the reactor of step (a) such that the thermowell member thermally communicates with the hydroconversion reaction zone of step (a);

(d) flowing a hydrocarbon feed stream through the bed of catalyst in the hydroconversion reaction zone of step (a);

(e) detecting a leak in the thermowell member of step (c); and (f) removing the thermocouple member while the hydrocarbon feed stream continues to flow through the bed of catalyst in the hydroconversion reaction zone in accordance with step (d).

The immediate foregoing moving step (f) comprises removing the thermocouple member from the thermowell assembly such that the thermowell member atmospherically communicates with the atmosphere, and sealably coupling a cap member to the thermowell assembly such that the thermowell member does not atmospherically communicate with the atmosphere. The cap member comprises a generally cylindrical cup-shaped structure having a solid cap bottom and a generally solid cylindrical cap wall integrally bound to the solid cap bottom to form a generally cylindrical cap recess for sealably engaging at least a portion of the thermowell assembly. The thermowell assembly additionally comprises a generally cylindrical bushing member supported by a hollow sleeve assembly and having a bushing bore passing therethrough and adaptable for slidably, sealably receiving the thermocouple member therethrough and wherein the cap recess section threadably, sealably engages an end of the generally cylindrical bushing member.

The present invention still yet further accomplishes its desired objects by broadly providing a method for stopping or arresting a leak through a thermowell member of a thermowell assembly supported by a generally cylindrical reactor wall of a reactor containing a hydroconversion reaction zone including a bed of catalyst having a hydrocarbon feed stream flowing therethrough comprising the steps of:

(a) providing in an atmosphere a reactor having a generally cylindrical reactor wall containing a hydroconversion reaction zone including a bed of catalyst;

(b) providing a thermowell assembly having a generally hollow sleeve assembly, a thermowell member supported by the generally hollow sleeve assembly, and a thermocouple member supported by the generally hollow sleeve assembly and extending into the thermowell member;

(c) supporting the thermowell assembly of step (b) with the generally cylindrical reactor wall of the reactor of step (a) such that the thermowell member thermally communicates with the hydroconversion reaction zone of step (a);

(d) flowing a hydrocarbon feed stream through the bed of catalyst in the hydroconversion reaction zone of step (a);

(e) detecting a leak in the thermowell member of step (c); and (f) plugging the thermowell assembly of step (c) to stop the leak of step (e) and to seal off the thermowell member from the atmosphere.

The thermocouple member is preferably removed from the thermowell assembly prior to the immediate foregoing plugging step (f) such that the thermowell member atmospherically communicates with the atmosphere. The immediate foregoing plugging step (f) additionally includes sealably coupling a cap member to the thermowell assembly such that the thermowell member does not atmospherically communicate with the atmosphere. The cap member comprises a generally cylindrical structure having a generally cylindrical cap recess section that is adaptable for sealably engaging the thermowell assembly. The thermowell assembly additionally comprises a generally cylindrical bushing member supported by the hollow sleeve assembly and having a bushing bore passing therethrough and adaptable for slidably, sealably receiving the thermocouple member therethrough. The cap recess section threadably, sealably engages an end of the cylindrical bushing member. The thermocouple may be wholly removed, or partially removed such as by severing the thermocouple, prior to the immediate foregoing plugging step (f), which as indicated allows the thermowell member to atmospherically communicate with the atmosphere. To facilitate the immediate foregoing plugging step (f), the cap member as indicated is sealably coupled to the thermowell assembly such that the thermowell member no longer atmospherically communicates with the atmosphere. The cap member in one embodiment is defined by a generally cylindrical cup-shaped structure having a solid cap bottom and a generally solid cylindrical cap wall integrally bound to the solid cap bottom to form a generally cylindrical cap recess for sealably engaging at least a portion of the thermowell assembly.

It is therefore an object of the present invention to provide an improved pipe union assembly.

It is another object of the present invention to provide a thermowell assembly.

It is yet another object of the present invention to provide a method for hydroprocessing a hydrocarbon feed stream that is flowing through a hydroconversion reaction zone having a bed of catalyst.

It is still yet another object of the present invention to provide a method for stopping or arresting a leak through a thermowell member of a thermowell assembly supported by a generally cylindrical reactor wall of a reactor containing a hydroconversion reaction zone including a bed of catalyst having a hydrocarbon feed stream flowing therethrough.

These, together with the various ancillary objects and features which will become apparent to those skilled in the art as the following description proceeds, are attained by this novel apparatus and method, preferred embodiments thereof shown with reference to the accompanying drawings, by way of example only, wherein:

DETAILED DESCRIPTION OF THE INVENTION

Figure 1:
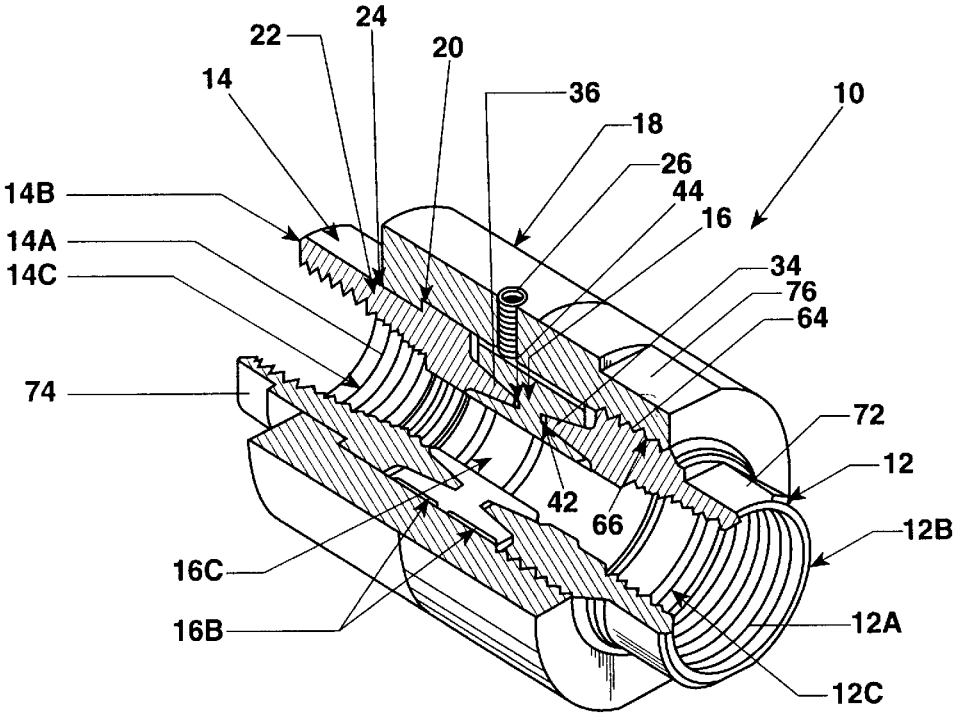
Fig. 1 (Prior Art)
FIG. 1 is a perspective view of a prior art pipe union assembly.
Figure 2:
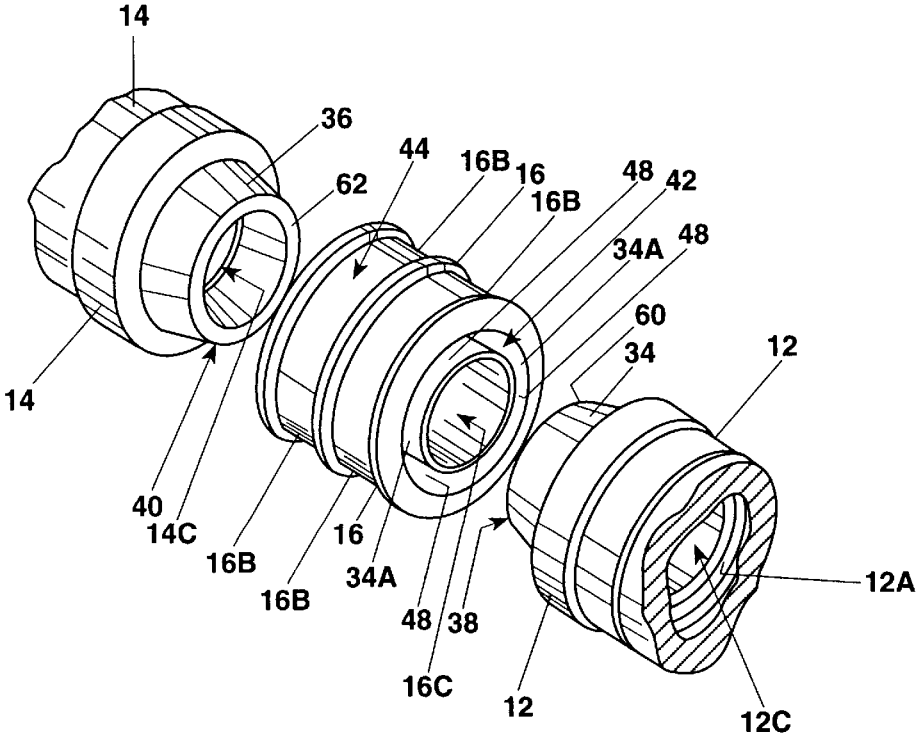
Fig. 2 (Prior Art)
FIG. 2 is a partial perspective view of a portion of the prior art pipe union assembly of FIG. 1.
Figure 3:
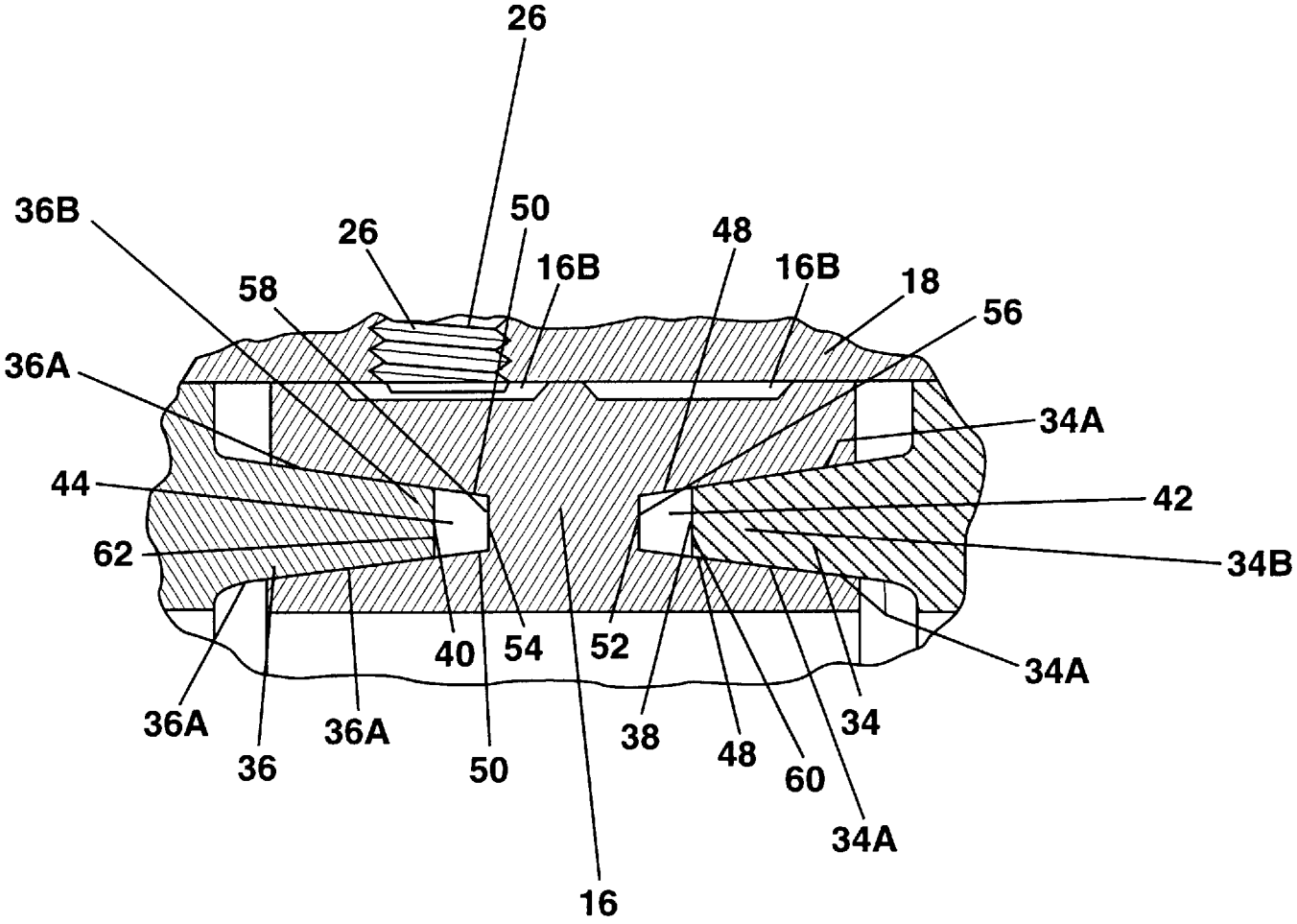
Fig. 3 (Prior Art)
FIG. 3 is a partial vertical cross sectional view of a portion of the prior art pipe union assembly of FIG. 1.

Referring in detail now to the drawings there is seen in FIGS. 1–3 a prior art pipe union assembly to Hiltap Fittings Ltd. of Calgary, Alberta, Canada and fully described in Canadian Patent No. 1,303,094 dated Jun. 9, 1992, and U.S. Pat. No. 5,355,908, which is fully incorporated herein by reference thereto as if repeated verbatim hereinafter. There is seen in FIGS. 4–18 various preferred embodiments of the present invention which are improvements over the prior art pipe union assembly of FIGS. 1–3. Similar parts of the present invention and the prior art pipe union assembly of FIGS. 1–3 are to be identified with like reference numerals.

The various preferred embodiments of the present invention in FIGS. 4–20 may be used for any suitable purposes including in any suitable apparatus and/or for any suitable process or method. One suitable purpose would be in any hydroprocessing process and/or at any suitable location in any hydroprocessing reactor. More particularly the various preferred embodiments of the present invention in FIGS. 4–20 may be employed in the hydroprocessing process and/or at any suitable location in the reactor of the hydroprocessing process which is discussed in detail in copending patent application Ser. No. 08/497,638, filed Jun. 30, 1995 and which is fully incorporated herein by reference thereto as if repeated verbatim immediately hereafter. As more particularly and fully discussed in the copending patent application Ser. No. 08/497,638, the upper level of a catalyst bed is to be controlled such that ebullation, expansion, or fluidization of the catalyst bed is minimized and that undesirable excursions from the design flow rate for hydrogen-containing gas and liquid hydrocarbon stream flowing upwardly through the catalyst bed are avoided for the selected catalyst. For this accomplishment and as discussed in detail in the copending patent application Ser. No. 08/497, 638, the size, shape, and density of the catalyst particles within the catalyst bed are to be essentially uniform and are selected in accordance with the designed maximum rate of flow of feed streams or a mixture of the hydrogen-containing gas and the liquid hydrocarbon stream to prevent ebullation, expansion, or fluidization of the catalyst bed while the latter progressively moves down through the reactor vessel in layers by plug flow.

Figure 8:
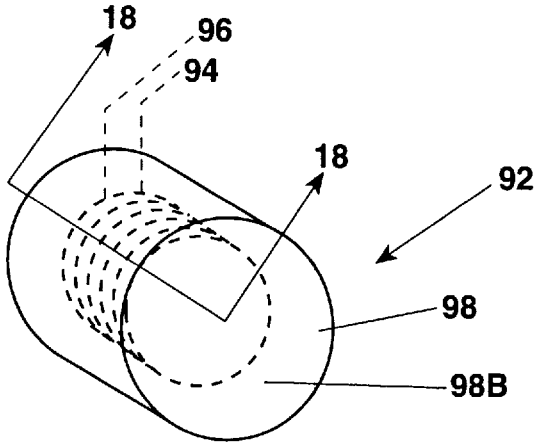
FIG. 8 is a perspective view of a solid bushing cap member which threadably engages the bushing member of FIG. 7 to seal off the opening or bore through the bushing member of FIG. 7.
Figure 9:
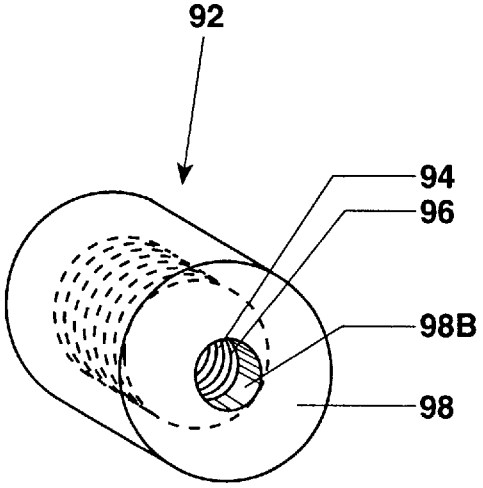
FIG. 9 is a perspective view of a cap member having a generally cylindrical opening or bore which communicates with the bore or opening in the bushing member of FIG. 7 and which threadably engages the bushing member to seal in the bushing seal or gasket member lodged in a recess in the bushing member.
Figure 21:
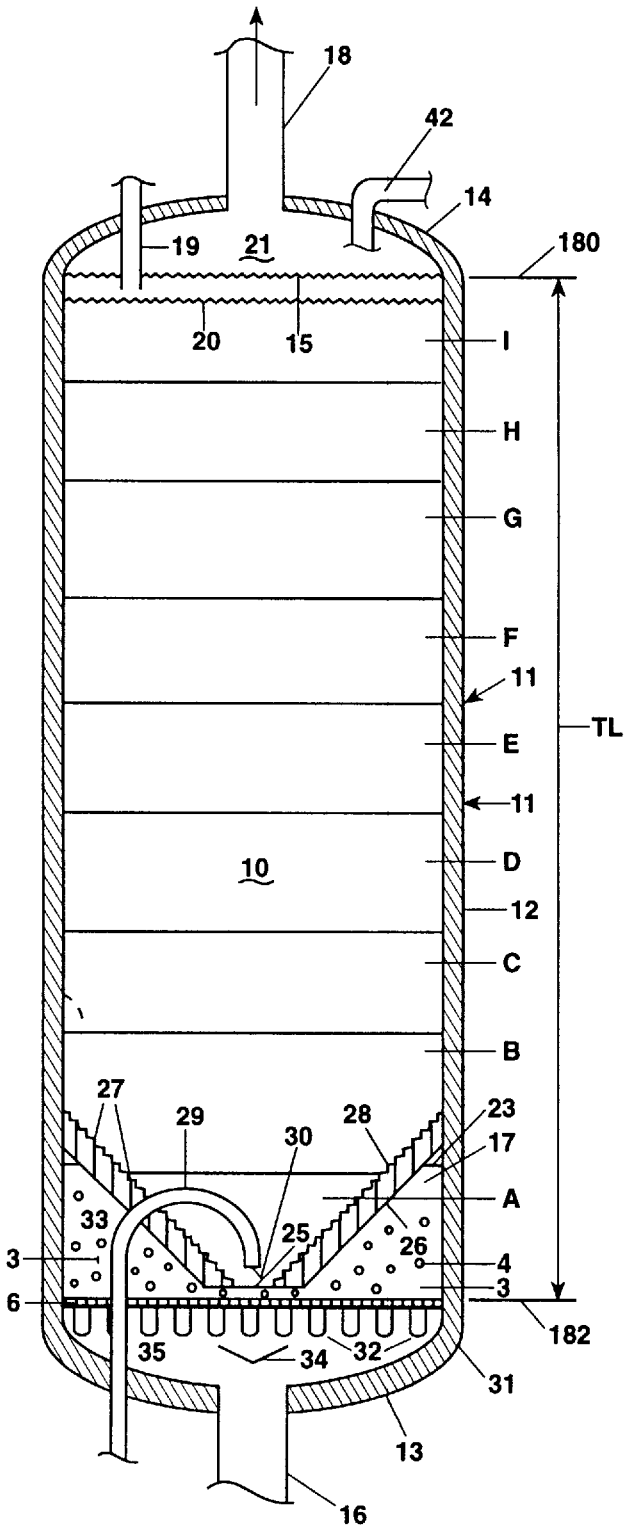
FIG. 21 is a partial cross sectional view of a reactor in FIG. 8 of copending patent application Ser. No. 08/342,527 filed Nov. 21, 1994 and illustrating a catalytic bed with a plurality of superimposed layers with respect to each other before commencement of a plug-flow.
Figure 22:
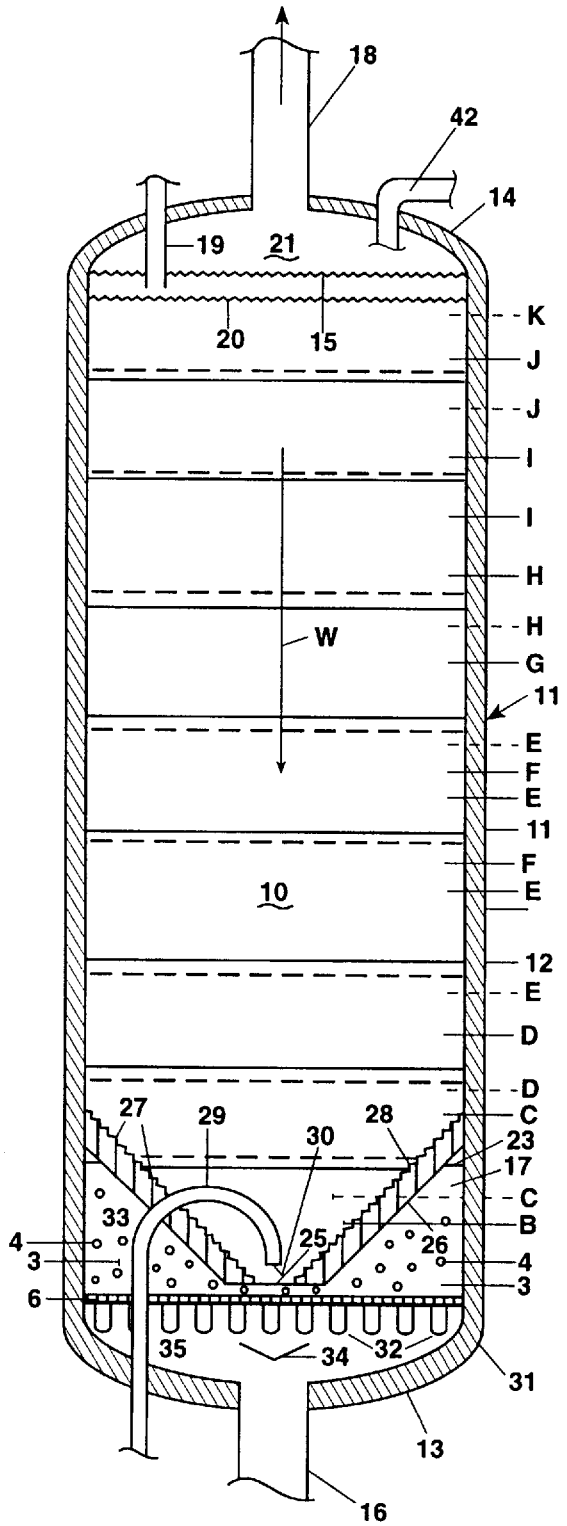
FIG. 22 is a partial sectional view of the reactor in FIG. 9 of the copending patent application Ser. No. 08/342,527 filed Nov. 21, 1994 which is moving downwardly in plug-flow fashion.

A "plug flow" of the catalyst bed is illustrated in FIGS. 21 and 22 (which are identical to FIGS. 8 and 9 in the fully incorporated copending application Ser. No. 08/342,527, filed Nov. 21, 1994 and may be best described as when a lowermost volumetric layer A is removed, the next volumetric layer B flows or moves downwardly to replace the lowermost volumetric layer A and assumes a new position as a lowermost volumetric layer B. The removed lowermost volumetric layer A is replaced with an upper volumetric layer J. The procedure is again repeated (as best shown by the dotted line representations in FIG. 22) by removing the lowermost volumetric layer B and causing the next volumetric layer C to flow downwardly in a plug-like fashion to replace the lowermost volumetric layer B and assume a new position as a lowermost volumetric layer C. The removed lowermost volumetric layer B is replaced with an upper volumetric layer K. The procedure may be continually repeated to define a downwardly plug-flowing catalyst bed which is moving in direction of arrow W in FIG. 22.

The pipe union assembly, generally illustrated as 10, includes a pair of hollow fitting members 12 and 14, a hollow sealing member or sealing ferrule 16, an external sleeve 18, a compensating washer 20, a restraining or safety clip 22, and a restraining clip groove 24 for receiving the restraining clip 22. Set screws 26 threadably pass through the external sleeve 18 to hold the ferrule 16 captive. In the embodiments in FIGS. 4–6, 16–17, and 19, the external sleeve 18 may further include threadable apertures or slots 28 for threadably receiving set screws 26 or the like for engaging the hollow fitting member 12. As seen in FIG. 1, fitting members 12 and 14 are generally cylindrically shaped with respective threads 12A and 14A formed around the inside of their associated outermost ends which are respectively identified as 12B and 14B. The diameter of fitting members 12 and 14 may be of any suitable diameter to join pipes (not shown in the drawings and which may include hoses, tubing, and any other conduit-like structure). The hollow fitting members 12 and 14 as well as the ferrule 16 are formed with interior cavities 12C, 14C and 16C respectively, all of which are generally cylindrical, but may be imposed with any configuration (e.g. elliptical, rectangular, etc.).

The material (i.e. various metals such as carbon steel, stainless steel, etc.) used to fabricate fitting members 12, 14 and ferrule 16 (e.g. Aluminum type 7075) must be carefully chosen in accordance with four criteria. These criteria for selection of the material are: (1) the material must exhibit sufficient strength so as to not be adversely effected when subjected to the temperatures and pressures of the expected operating conditions; (2) the material must be resistant to any corrosive action from the immediate surroundings; (3) the material must have an appropriate thermal expansion coefficient; and (4) the material must have an appropriate hardness; that is the hardness of the various materials must have an appropriate industry standard Brinell hardness scale.

As can be seen best in the drawings, the fitting members 12 and 14 have a corresponding respective perimetric tapered ridge 34 and 36 at a corresponding innermost end 38 and 40. The term "perimetric" is adopted herewith to describe tapered ridges 34 and 36 and tapered channels (see "42" and "44" below) since ridge 34 is disposed around the perimeter of the interior cavity 12C formed within fitting member 12. Thus, perimetric tapered ridge 34 peripherally defines an extremity of the opening of cavity 12C formed through fitting member 12. Likewise, perimetric tapered ridge 36 peripherally defines an extremity of the opening of cavity 14C.

Sealing member 16, also referred to as ferrule 16, is provided with two perimetric tapered channels, generally designated 42 (see FIGS. 2, 3, and 4) and 44. (see FIGS. 2 and 3), are configured to receive the corresponding perimetric tapered ridge 34 and 36 of the respective fitting members 12 and 14. Advantageously, sealing member 16 of the present invention is self aligning in that once tapered ridge 34 is inserted into tapered channel 42, no further positioning of sealing member 16 is required by the person assembling the union.

Ferrule 16 is preferably shaped so as to match the shape of interior cavity 12C and the exterior shape of fitting member 12. Thus, if fitting member 12 is cylindrical, as shown in the figures, the shape of ferrule 16 is preferably also cylindrical. The perimetric tapered channels 42 and 44 are located on opposite faces of the ferrule 16 and are provided with two arcuate walls 48—48 and 50—50 respectively. Channel bottoms 52 and 54 of channels 42 and 44 respectively are provided with two flat walls 56 and 58 that terminate in arcuate walls 48—48 and 50—50 (e.g. see FIG. 5) respectively and are preferably smooth and flat. The ferrule 16 is formed with at least one perimetric ferrule recess 16B. The set screws 26 protrude into the recess(es) 16B but do not necessarily contact the ferrule 16, more specifically do not necessarily contact the bottom of the recess(es) 16B. In this way, ferrule 16 may be generally "loosely" held in contact with fitting members 12 and 14 so as to be postured for insertion of the ridges 34 and 36 respectively. Also, since the ferrule 16 has been captivated by set screws(s) 26, it will not be misplaced. However, ferrule 16 should preferably still be allowed to rotate freely so set screw 26 is preferably not to be inserted too far. However, any set screw(s) 26 passing through slot(s) 28 is(are) to be a locking set screw 26 (see FIGS. 4–6), preferably one with a cone point, to contact and/or lock-in hollow coupling member 12.

As best shown in FIG. 3, tapered ridge 34 is configured so that a flat wall end 60 thereof cannot come into contact with a flat wall end 56 of channel bottom 52. Thus, the narrowest portion of tapered ridge 34 should not be as narrow as the narrowest portion of channel 42. Accordingly, tapered ridge 34 cannot completely penetrate perimetric channel 42, although since the angle of the channel walls 48 and the angle of the ridge sides 34A, relative to the axis of the fitting assembly 10 are most preferably essentially identical, a very precise mating occurs between channel walls 48 and tapered ridge sides 34A. Similarly, tapered ridge 36 is configured so that a flat wall end 62 thereof cannot come into contact with a flat wall end 58 of channel bottom 54. Thus, the narrowest portion of tapered ridge 36 should not be as narrow as the narrowest portion of channel 44. Accordingly, tapered ridge 36 cannot completely penetrate perimetric channel 44, although since the angle of the channel walls 50 and the angle of the ridge sides 36A, relative to the axis of the fitting assembly 10 are most preferably essentially identical, a very precise mating occurs between channel walls 50 and tapered ridge sides 36A.

As can be appreciated by examining the structure shown in FIG. 3, rather than incorporating a single sealing surface, two sealing surfaces are provided on the tapered ridge 34 and tapered channels 42. More particularly, each tapered ridge 34 is provided with two identical sides 34A—34A and each tapered channel 42 is provided with two identical walls 48—48. Since at least one of these sides 34A—34A makes sealing contact with a corresponding wall 48, two sealing surfaces are created by a mating tapered ridge 34 and tapered channel 44 pair. Likewise, two sealing surfaces are provided on the tapered ridge 36 and tapered channel 44. More specifically, each tapered ridge 36 is provided with two identical sides 36A—36A and each tapered channel 44 is provided with two identical walls 50—50. Since at least one of these sides 36A—36A makes sealing contact with a corresponding wall 50, two sealing surfaces are created by a mating tapered ridge 36 and tapered channel 42 pair. This perhaps redundancy of sealing structures enhances the seal formed between the subject fitting members 12 and 14 and ferrule 16, and thus provides improved sealing characteristics.

The external sleeve 18 is provided with sleeve threads 64 that threadably engage fitting member threads 66 that are on the outside of fitting member 12. Fitting members 12 and 14 and sleeve 18 may be provided with areas that are typically called "wrench flats" 72, 74 and 76, respectively. These wrench flats are provided in order to allow convenient grasping of the subject structures of the various embodiments by a wrench (not shown) or any other similar tool.

Figure 5:
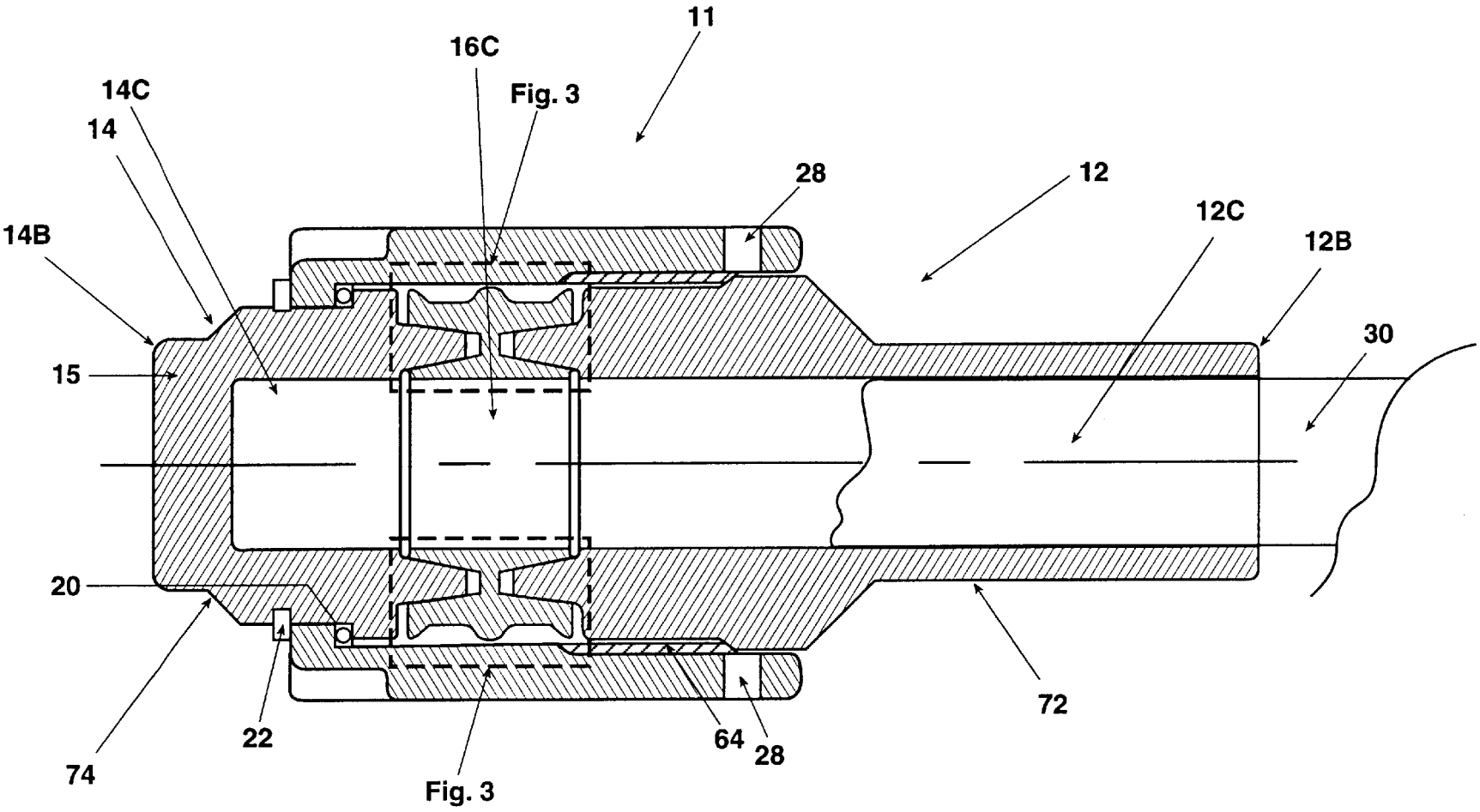
FIG. 5 is a vertical sectional view of an embodiment of the present invention the thermowell pipe having been removed.
Figure 6:
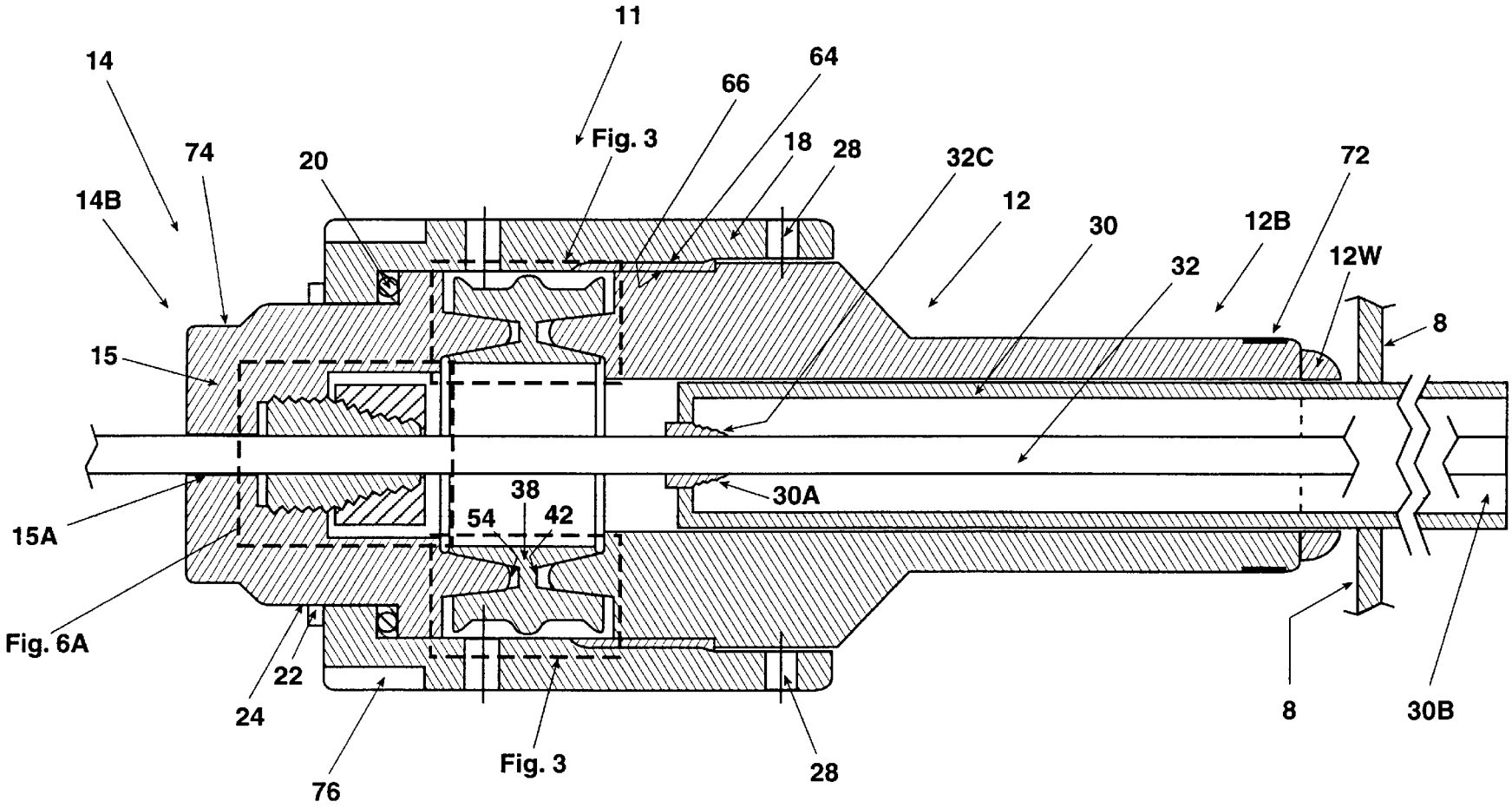
FIG. 6 is a vertical sectional view of an embodiment of the present invention having a thermowell member with a thermocouple member passing into the thermowell member and through an opening in a bushing assembly and through an opening in a solid generally cup-shaped ceiling member containing the bushing assembly in a recess thereof.
Figure 6A:
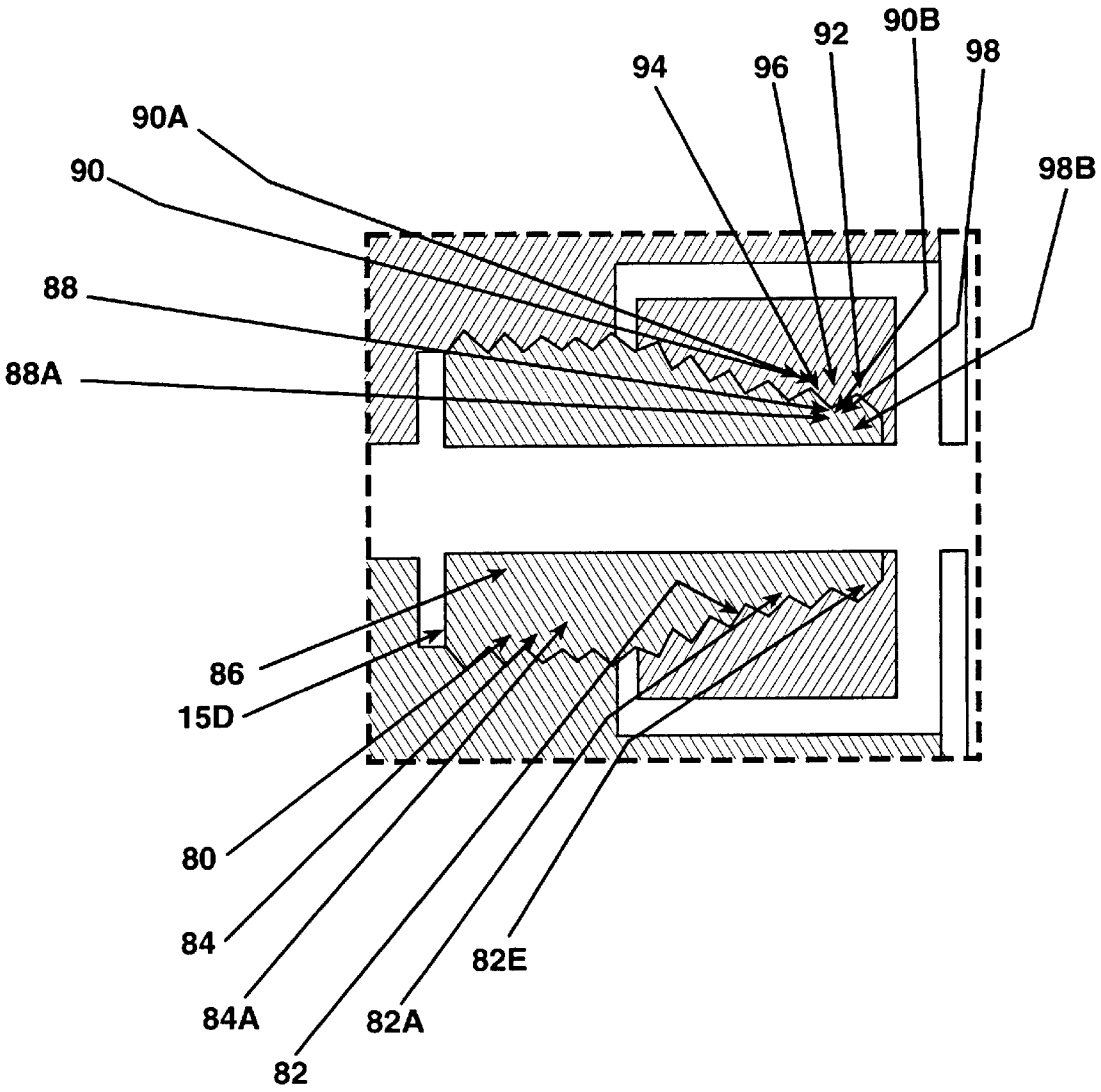
FIG. 6A is a portion of an embodiment of the present invention showing details of a bushing assembly.

Referring generally now to FIGS. 4–20 for discussion of the improved pipe union assembly and/or the improved thermowell assembly of the present invention, there is seen in FIG. 6 or 6A one preferred embodiment of the improved thermowell assembly (and/or improved pipe union assembly), generally indicated as 11. The thermowell assembly 11 represents an improvement to and over the pipe union assembly 10 shown in FIGS. 1–3, and as previously indicated, like reference numerals are used to indicate similar parts. A typical thermowell pipe or member 30 as used in a hydroconversion reactor (such as that shown in FIGS. 21–22 and discussed hereinafter) in a conventional manner is sealably coupled to end 12B of the hollow fitting member 12, by any suitable means, preferably by a weld 12W or tapered threads, such that one end of the thermowell member 30 protrudes into the inner cavity 12C of fitting member 12.

Preferably, the hollow fitting 12 is fabricated such that the inner diameter of the hollow fitting 12 accommodates the outer diameter of the thermowell member 30 so as to facilitate sealably welding the weld 12W (or threadably engaging) the hollow fitting 12 thereto. In one preferred embodiment the diameter of the inner cavity 12C in relation to the outer diameter of the thermowell member 30 is such that an inner diameter of the sealing member 16 is somewhat larger than the outer diameter of the thermowell member 30, in order to permit free rotation of the sealing ferrule member 16 as previously discussed, unhindered by the thermowell member 30.

It can be appreciated that, in another preferred embodiment, the outer diameter of the thermowell member 30 may be approximately equivalent to the inner diameter of the cavity 12C for threadably coupling the improved thermowell assembly 11 with the thermowell member 30. However, it is more preferred to weld the thermowell member 30 to the fitting member 12 via the weld 12W, as shown in FIGS. 4, 6, 16–17, and 19–20. It can be seen in FIG. 6 that an inner diameter of the inner end 38 is larger than the inner diameter of the end 12B, attendant to accommodating the diameter of the sealing ferrule member 16. One advantage to this arrangement is to permit installation of a thermowell pipe plug member 30P (see FIG. 4), such as a bolt member, in the thermowell member 30 without hindrance or blockage of an installation tool (e.g. a socket/wrench) by the hollow fitting member 12 (e.g., hinderance/blockage such as may be caused by tolerances that are too close to permit insertion of the tool(s)).

Figure 4:
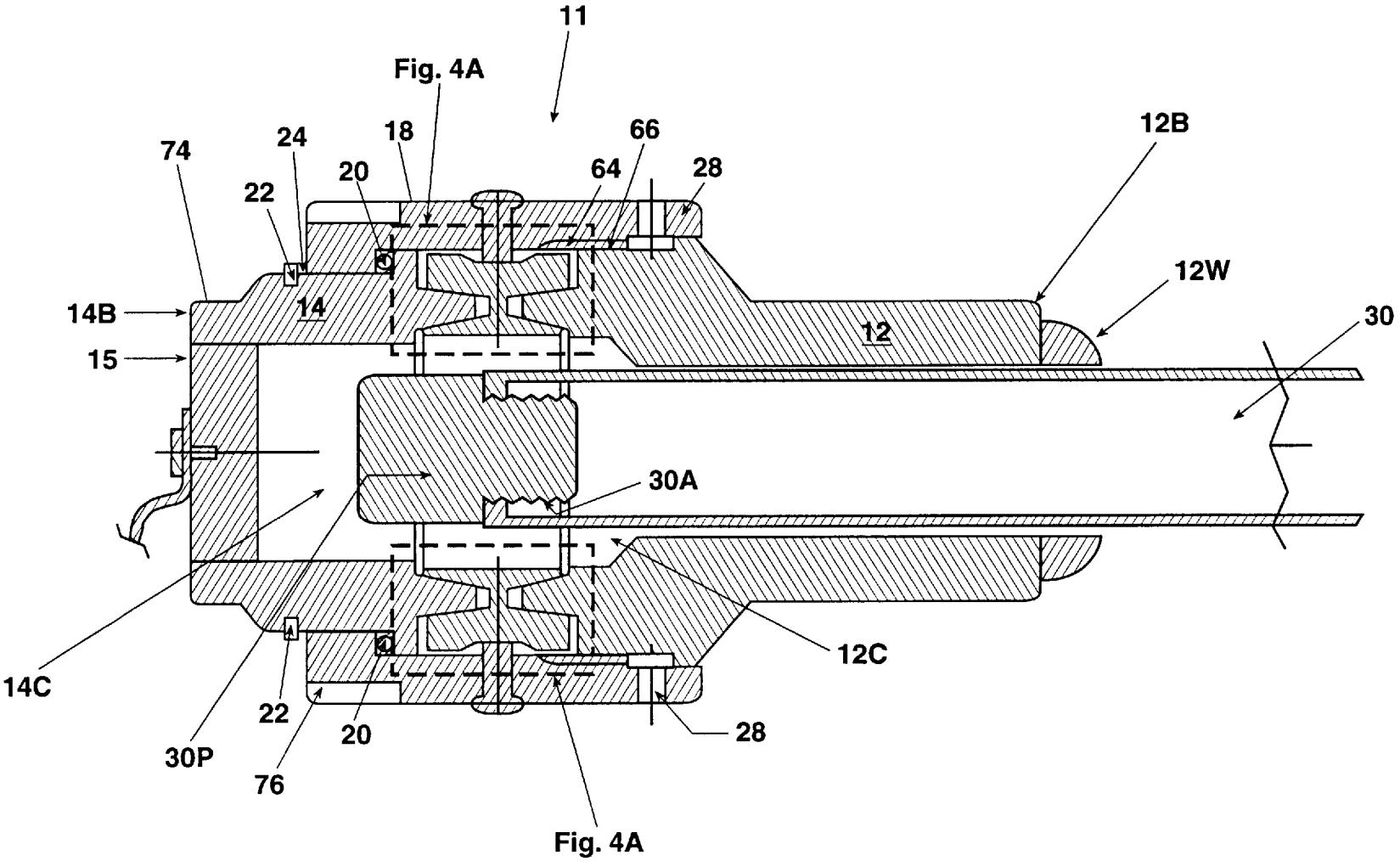
FIG. 4 is a vertical sectional view of one embodiment of the present invention having a thermowell pipe containing a plug.
Figure 4A:
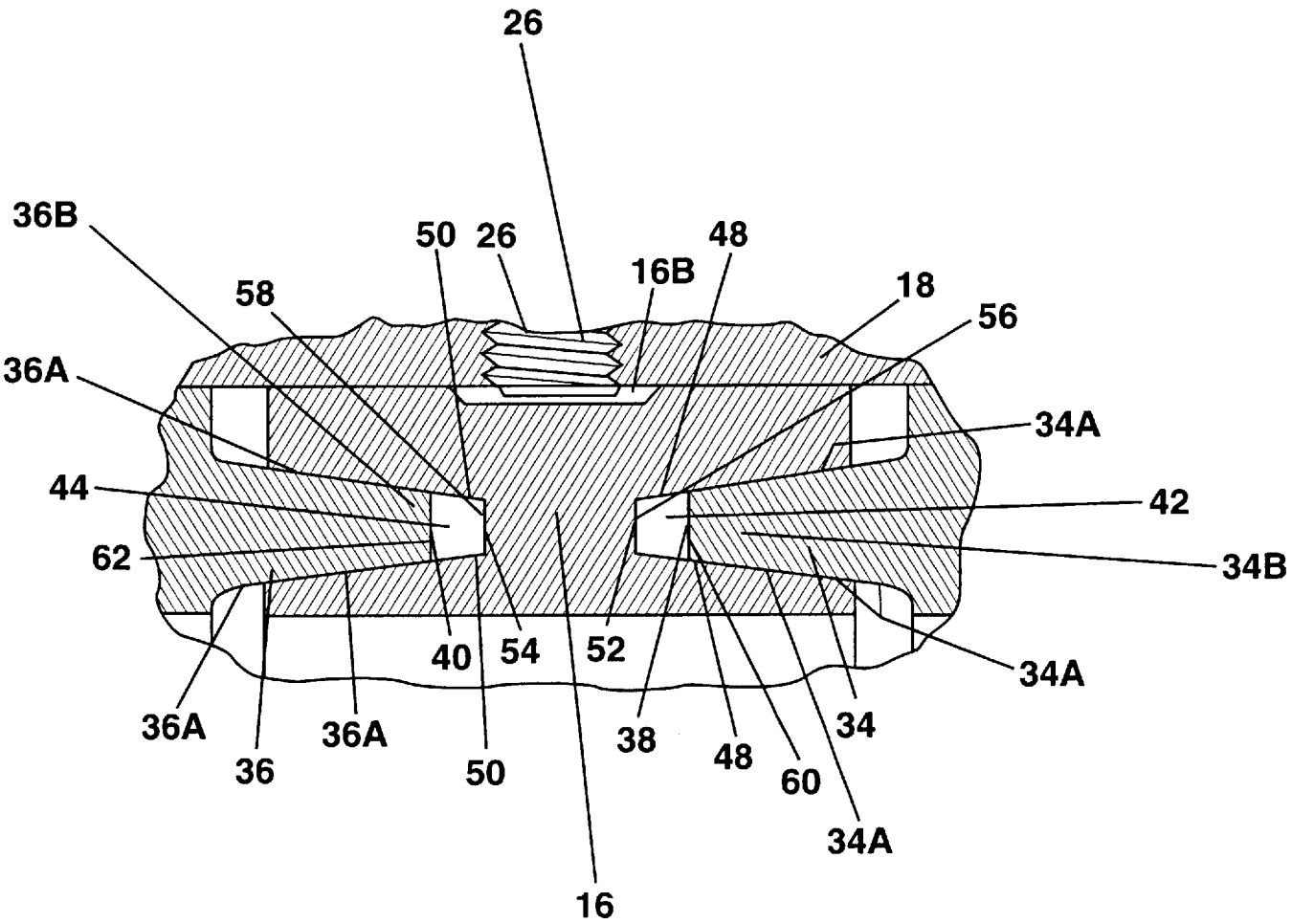
FIG. 4A is a portion of an embodiment of the present invention showing details of a sectional view of a hollow sealing member.
Figure 19:
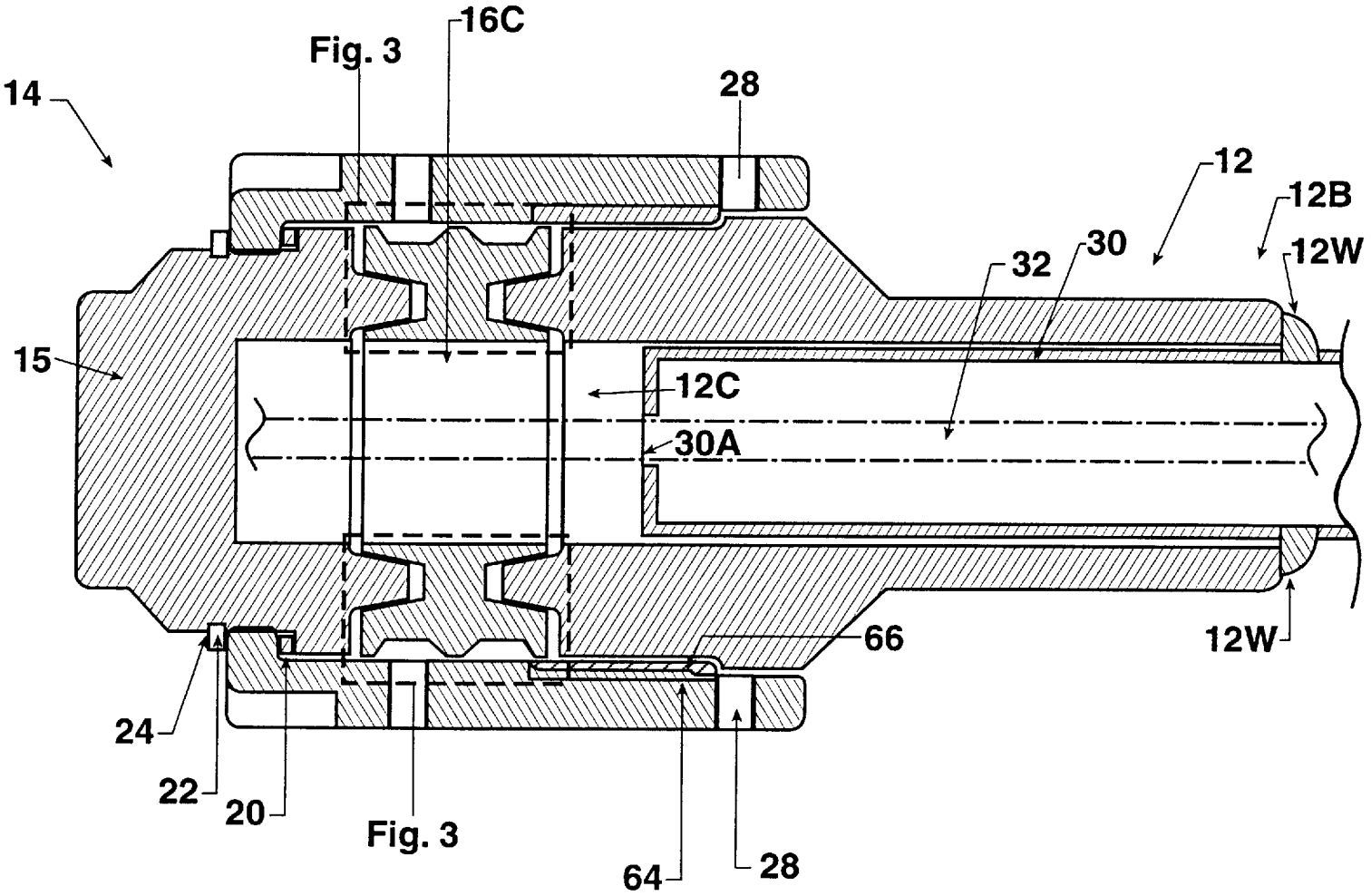
FIG. 19 is a sectional view of an embodiment of the present invention with the thermocouple member removed from a leaking thermowell member that is engaged to one of the fitting members and with a generally solid cup-shaped end member atmospherically closing or sealing off the leaking thermowell member from the atmosphere.

Hollow fitting member 14 (see FIGS. 16 and 19) is provided such that the end 14B is formed with a wall member 15 generally normal to the axis of the hollow fitting member 14 such that wall member 15 sealably closes internals of the thermowell assembly 11 from communication with the atmosphere. Thus, in this embodiment of the improved thermowell assembly 11 of the present invention, the hollow fitting member 14 and the wall member 15 in combination form a structure which is generally cup-shaped (i.e., a generally cup-shaped second end) in vertical cross-section (see FIGS. 4–5, 19). In an alternate embodiment, another generally cup-shaped, hollow fitting member 14/wall member 15 combination may be provided with the wall member 15 having an aperture 15A (see FIG. 6) for passing and/or slidably receiving a thermocouple member 32 therethrough. Thus, if and/or when the thermowell member 30 commences leakage, the hollow fitting member 14 and the wall member 15 having the aperture 15A is de-coupled from the thermowell assembly 11, in a manner to be described below, and the hollow fitting member 14/wall member 15 without aperture 15A combination is fitted to the thermowell assembly 11, as shown in FIGS. 4–5, 19, to seal-off the leaking thermowell member 30 from the atmosphere.

Figure 17:
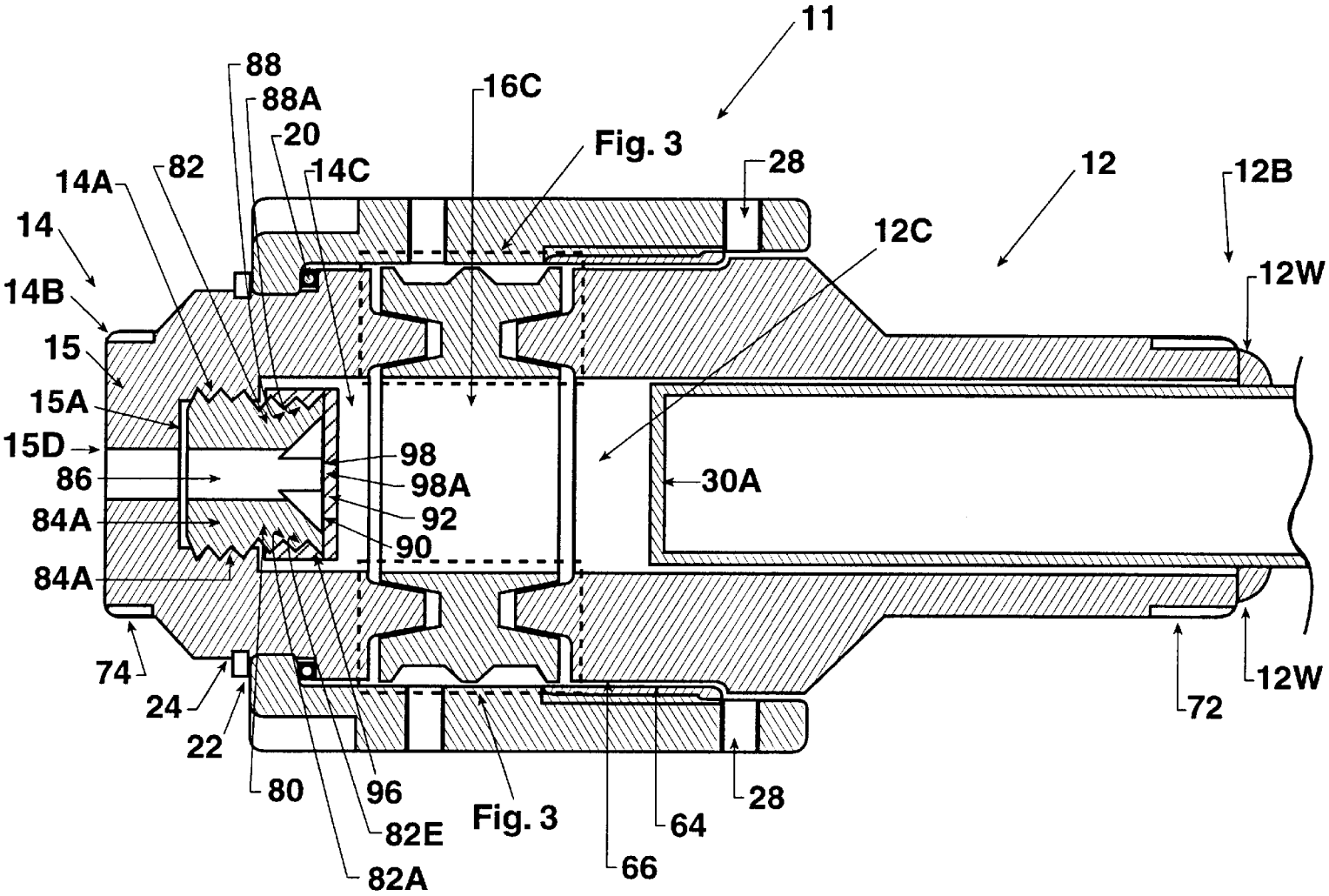
FIG. 17 is a sectional view of an embodiment of the present invention after the thermal couple has been removed and after the solid bushing cap member of FIG. 8 has been engaged to the bushing member to seal off a leaking thermowell member from the atmosphere.
Figure 18:
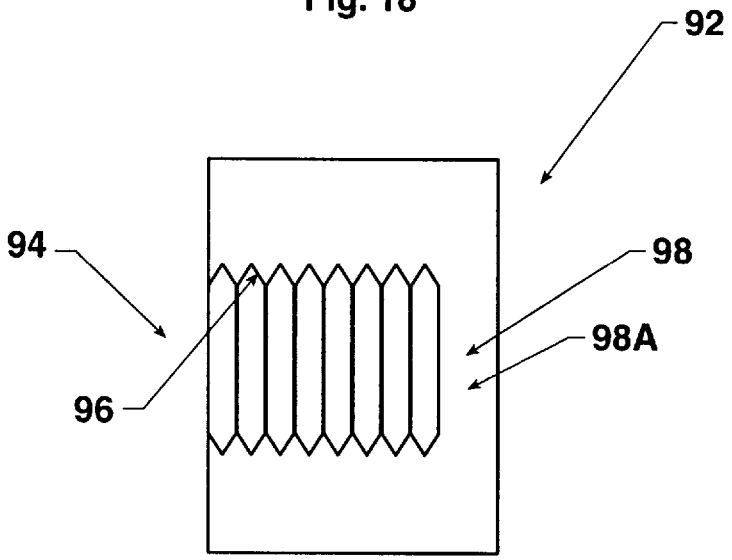
FIG. 18 is a vertical sectional view taken in direction of the arrows and along the plane of line 18—18 in FIG. 8.
Figure 20:
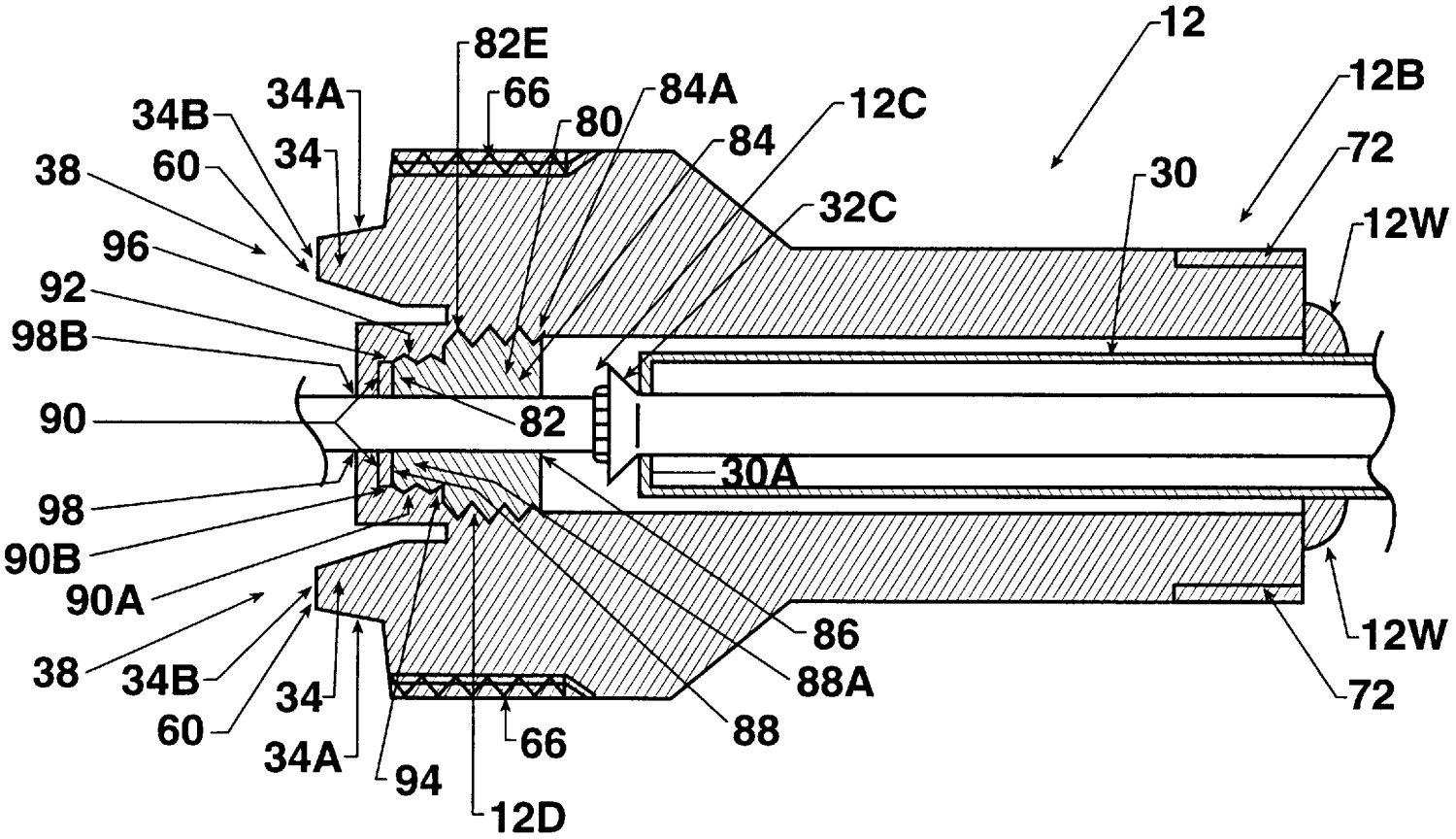
FIG. 20 is a sectional view of another embodiment of the present invention depicting the bushing assembly engaged to the generally hollow fitting member and having a thermowell member also engaged thereto with the thermocouple member passing through the bushing assembly and into the thermowell member.

In another embodiment of the improved thermowell assembly 11 of the present invention as shown in FIGS. 6, 6A and 17, the hollow fitting member 14 is adapted for receiving and being coupled to a bushing assembly 80. The bushing assembly 80 is provided with an outer bushing body or section 84 sealably engaged (i.e., with threads, welds, or the like) in a fitting recess 15D within the inner cavity 14C of hollow fitting member 14, more specifically within a fitting recess 15D in the wall member 15. The bushing assembly 80 is suited for sealably engaging the exterior of the thermocouple member 32 and/or for sealing the inner cavity 14C of the hollow fitting member 14, as to be explained. In this embodiment, as shown in FIGS. 6, 6A, 17, and 20, the hollow fitting member 14 is provided with inner threads 14A within the fitting recess 15D adapted for sealably, threadably engaging the bushing assembly 80, more particularly for sealably, threadably engaging the outer bushing body or section 84. It is appreciated that in this embodiment, the wall member 15 may be integrally bound to the outer end 14B of the hollow fitting member 14, as previously discussed and as shown in FIG. 6. Additionally the improved thermowell assembly 11 in yet another embodiment may omit the hollow fitting member 14 altogether, as shown in FIG. 20.

Figure 7:
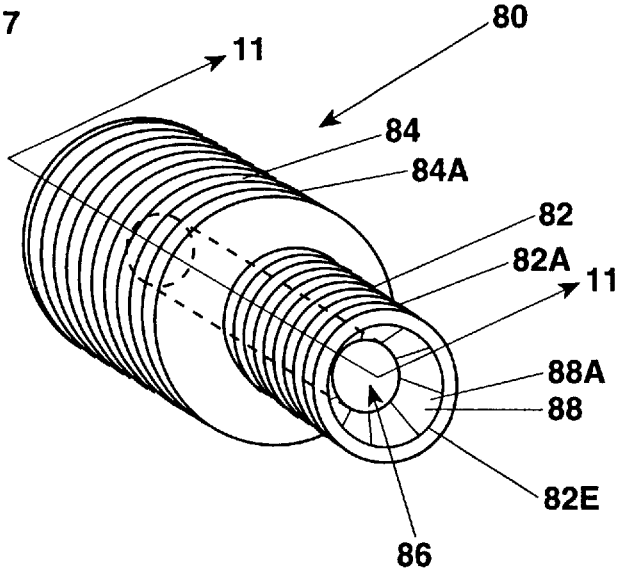
FIG. 7 is perspective view of a bushing member of the bushing assembly for the present invention.

As best shown in FIGS. 7–14, the bushing assembly 80 is generally tubular or cylindrical in shape, and is defined by the outer bushing body or section 84 and an inner bushing body or section 82 integrally bound to the outer bushing body or section 84 and axially aligned therewith. The outer bushing section 84 as shown in FIG. 7 has a threaded outer diameter 84A for threadably engaging the hollow fitting member 14, more specifically for threadably engaging the inner threads 14A within the fitting recess 15D in the wall member 15, all as previously indicated and as shown in FIGS. 6 or 6A. The inner bushing body or section 82 has a threaded outer diameter 82A with an outside diameter that is less than the threaded outer diameter 84A of the outer bushing section 84. The spirit and scope of the present invention includes that any suitable means may be employed for sealably securing the bushing body or section 84 to the hollow fitting member 14, such as sealed threads, sealed tapered threads, welds, or the like. The diameters of the inner bushing body or section 82 and the outer bushing body or section 84 are chosen such that clearance of the perimetrical ridge 36 (see FIG. 6) is assured.

While the bushing assembly 80 may be manufactured from any suitable material, the bushing assembly 80 is preferably manufactured from a single, integral piece of material. As indicated previously in the selection of the material for the sealing ferrule 16, the material selected for the bushing member 80 may be preferably one in which the following criteria are met: (1) the material exhibits sufficient strength so as to not be adversely effected when subjected to the temperatures and pressures of the expected operating conditions; (2) the material is resistant to any corrosive action emanating from the surroundings thereof; (3) the material has an appropriate thermal expansion coefficient; and (4) the material has an appropriate hardness.

The bushing assembly 80 further comprises an axial bore 86 of a diameter generally equivalent to the outside diameter of the thermocouple member 32 employed (i.e., the diameter of the axial bore 86 is slightly larger in order to accommodate the thermocouple member 32 therethrough) so that the axial bore 36 and the thermocouple member 32 are generally frictionally coupled (see FIGS. 6 or 6A) while being generally axially aligned. A bushing cap member, generally illustrated as 92, is provided with a threaded inner bore 94 having threads 96 for threadably engaging the inner bushing section 82. More specifically, the bushing cap member 92 includes the threaded inner bore 94 with threads 96 for threadably coupling to the inner bushing section 82, and a cap end 98. As shown in FIG. 9, the cap end 98 may feature an aperture 98B wherethrough the thermocouple member 32 frictionally and/or slidably passes. The aperture 98B is capable of being axially aligned with the axial bore 86 and is generally circular or cylindrical and comprises a diameter which is essentially equivalent to the diameter of the axial bore 86 of the bushing assembly 80.

Alternatively, when no thermocouple member 32 is desired to be situated in the thermowell assembly 11 (see FIG. 17), or when the thermocouple member 32 has been removed after a leak in the thermowell member 30 has been detected, a similar cap 92 is provided with end 98 featuring a closed end 98A (see FIGS. 8 and (18). Thus two embodiments of the cap members 92 may be employed in the bushing assembly 80. One cap member 92 features closed end 98A which is employed with the bushing assembly 80 when no thermocouple 32 is disposed in the thermowell assembly 11 and/or in order to seal-off a leaking thermowell member 30 from an atmosphere, as shown in FIG. 17. Alternatively, cap member 92 featuring aperture 98B is employed when the thermocouple member 32 is situated in the thermowell member 30 of the thermowell assembly 11, as shown in FIG. 6. The thermowell member 30 (as well as its remaining associated thermowell assembly 11) is typically supported by a hydroprocessing reactor structure 8 (see FIG. 6) such that the thermocouple member 32 thermally communicates with an internal temperature inside the hydroprocessing reactor structure 8 (e.g. a reactor wall) when disposed as represented in FIG. 6.

Figure 10:
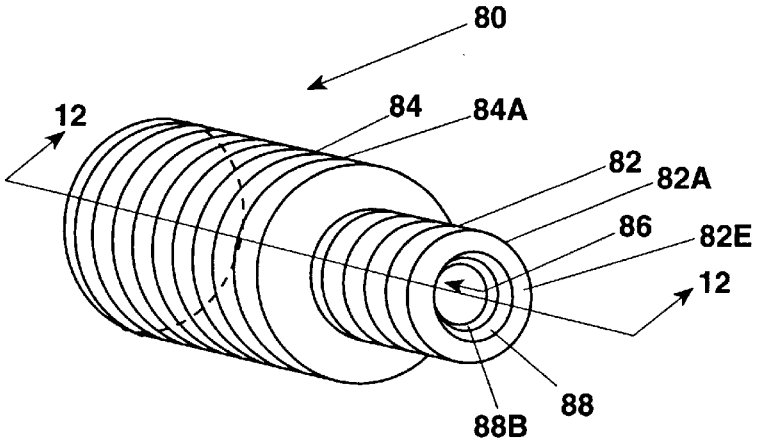
FIG. 10 is another embodiment of the bushing member of FIG. 7.
Figure 11:
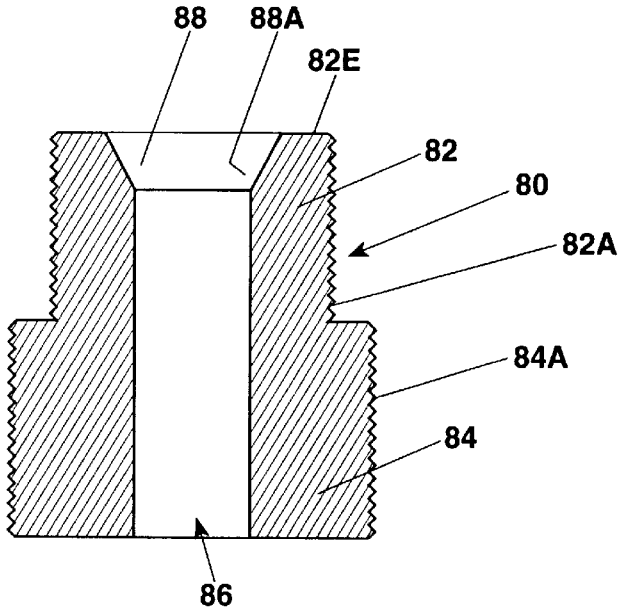
FIG. 11 is a sectional view taken in the direction of the arrows and along the plane of line 11—11 in FIG. 7.
Figure 12:
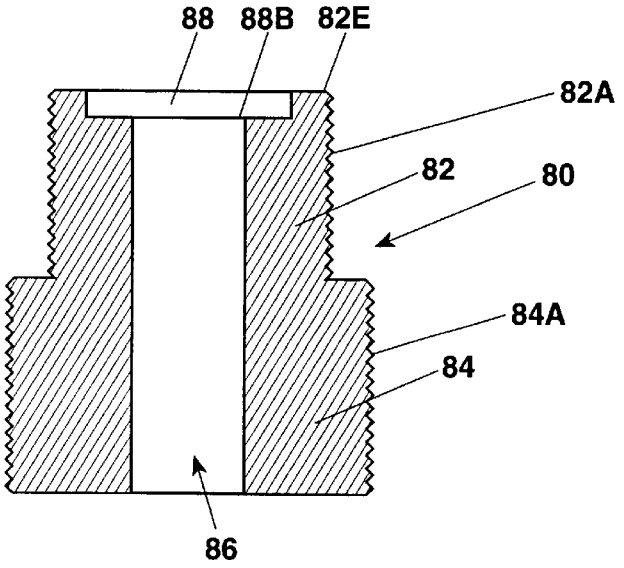
FIG. 12 is a sectional view taken in direction of the arrows and along the plane of line 12—12 in FIG. 10.
Figure 13:
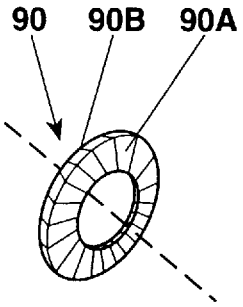
FIG. 13 is a perspective view of a frustro-conical or truncated-conical shaped (in vertical cross-section) bushing sealing member or gasket for the bushing assembly of the present invention and for lodging in the frustro-conical or truncated-conical shaped recess in FIG. 11.
Figure 14:
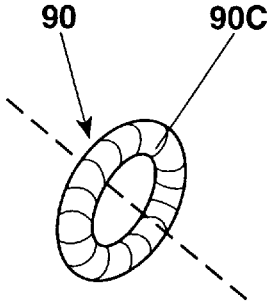
FIG. 14 is a perspective view of a squared or rectangular shaped (in vertical cross-section) bushing sealing member or gasket for the bushing assembly of the present invention and for lodging in the squared or rectangular shaped recess in FIG. 12.

As best shown in FIGS. 7 and 10, the inner bushing section 82 is provided with a seal recess 88 which is coaxially aligned with axial bore 86 and formed in end 82E of the inner bushing section 82 for accommodating a washer or seal member, indicated a 90 in FIG. 6A. The seal member 90 and the seal recess 88 are complementary in shape and may form any of a number of forms or structures. Two embodiments of the seal member 90 are shown by way of example only in FIGS. 13 and 14. FIG. 13 shows the seal member 90 as having a frustro-conical edge 90A for accommodating a corresponding frustro-conically shaped edge 88A (see FIGS. 7 and 11) in the inner bushing section 82 of the bushing assembly 80, and a flat edge 90B for engaging the bushing cap member 92 and/or the thermocouple member 32 (see FIGS. 6 and 6A). Similarly, FIG. 14 shows the seal member 90 as having a generally circular or arcuate edge 90C for accommodating a corresponding generally flat, annular recessed edge 88B of the recess 88 in the inner bushing section 82 as shown in FIGS. 10 and 12. The seal member 90 may be fabricated of any suitable material which may sealably engage the exterior of the thermocouple member 32 (see FIGS. 6 or 6A) and the inner edge 98B of the end 98 of the cap member 92 (e.g., any of a variety of rubber, plastics or metals).

In the embodiment of the present invention depicted in FIG. 20, the bushing assembly 80 is disposed in hollow fitting member 12 instead of hollow fitting member 14. For this embodiment, the inner cavity 12C of the hollow fitting member 12 is provided with internal threads 12D that threadably engage the outer bushing section 84 as shown in FIG. 20. The ferrule 16 may not necessarily be employed, but with only the hollow fitting member 12 employed having the wall member 15 including the aperture 15A so that the thermocouple member 32 may conveniently extend therethrough. The thermowell member 30 may have an open end 30A and a closed end 30B (see FIG. 6). The thermocouple member 32 may have a thermocouple sealing member 32C (see FIGS. 6 and 20) secured therearound for at least partially sealing-off the open end 30A of the thermowell member 30 when the thermocouple member 32 passes through the open end 30A and extends into the closed end 30B. If the thermowell member 30 begins to leak, the thermocouple member 32 may be either pulled out of the thermowell assembly 11 (i.e. pulled through and out of open end 30A, pulled through and out of the axial bore 86 of the bushing sections 82 and 84, and pulled through and out of the aperture 15A of the wall member 15) or severed at a point immediately outside of the open end 30A of the thermowell member 30. Subsequently, the hollow fitting member 14/wall member 15 having aperture 15A is removed and uncoupled from the hollow fitting member 12 and is replaced with the hollow fitting member 14/wall member 15 (without aperture 15A) combination to seal-off the leaking thermowell member 30 from the atmosphere.

Continuing to refer in detail now to the drawings for operation of the present invention and the method for hydroprocessing a hydrocarbon feed stream that is flowing through a hydroconversion reaction zone having a bed of catalyst, the improved thermowell assembly 11 of the present invention (see FIG. 6) is preferably disposed such that the thermowell member 30 is supported by the reactor structure 8. The reactor structure 8 may be any part of a hydroconversion reactor wherein the internals of the reactor are to be thermally monitored to insure that no "hot-spots" develops inside a hydroconversion reactor. The reactor structure 8 is preferably a generally cylindrical reactor wall containing the hydroconversion reaction zone with the bed of catalyst. The improved thermowell assembly 11 (such as that illustrated in FIG. 6) is preferably supported by the generally cylindrical reactor wall (i.e. reactor structure 8) such that the remaining elements (e.g. hollow fitting member 12, ferrule 16 if employed, fitting member 14, and external sleeve 18 if employed, etc.) of the improved thermowell assembly 11 are also supported by the generally cylindrical reactor wall (i.e. reactor structure 8) and further such that the thermocouple member 32 is also supported by the improved thermowell assembly 11 while extending through the open end 30A of the thermowell member 30 and into the thermowell 30 to preferably be in contact with the closed end 30B for thermally monitoring temperatures within the generally cylindrical reactor wall (i.e. the reactor structure 8).

Over an extended period of time, the thermowell member 30, especially that part of the thermowell member 30 extending into the inside of the generally cylindrical reactor wall or reactor structure 8, will begin to leak from corrosion caused by hydrocarbon feed streams containing corrosive components such as $H_2S$. A leaking thermowell member 30 can become dangerous; therefore, the thermowell assembly 11 should be plugged to stop the leaking thermowell member 30 in order to seal-off the thermowell member 30 from the atmosphere. As previously indicated, plugging of the thermowell assembly 11 may be accomplished in a variety of ways. Plugging is preferably done while the hydrocarbon feed stream continues to flow through the bed of catalyst in the hydroconversion reaction zone in order not to shutdown the hydroconversion reactor which is hydroprocessing the hydrocarbon feed stream.

One suitable means or way of plugging the thermowell assembly 11 is to remove the thermocouple member 32 while the hydrocarbon feed stream continues to flow through the bed of catalyst in the hydroconversion reaction zone. The thermocouple member 32 is removed from the thermowell assembly 11 by: (i) pulling the thermocouple member 32 through the open end 30A of the thermowell member 30 such that the thermocouple member 32 has left the thermowell member 30 and is no longer thermally communicating with the inside of the generally cylindrical reactor wall or reactor structure 8; and (ii) subsequently pulling, removing and passing the thermocouple member 32 through the aperture 98B of the bushing cap member 92, through the opening of the seal/washer 90, through the axial bore 86 of the bushing assembly 80 (i.e the bushing sections 82 and 84), and through the aperture 15A in the wall member 15 of the hollow fitting member 14. After the thermocouple member 32 has been completely removed from the thermowell assembly 11, the leaking thermowell member 30 atmospherically communicates with the atmosphere. Since it is highly desirable to close-off or seal-off the leaking thermowell member 30 from the atmosphere, any of the variety of cap members disclosed herein may be employed for such sealing or closing-off purposes in order that the thermowell member 30 does not atmospherically communicate with the atmosphere.

One means or way for plugging the thermowell assembly 11 would be to replace the hollow fitting member 14 having the wall member 15 with aperture 15A (see FIG. 6) with the hollow fitting member 14 having the wall member 15 without any aperture 15A, as best shown in FIG. 5. Such replacement may be easily accomplished by removing the safety clip 22; unscrewing the external sleeve 18 off of the hollow fitting member 12; sliding the fitting member 14 of FIG. 6 off and away from the external sleeve 18 and subsequently sliding into the same place the fitting member 14 without aperture 15A; and then disposing the safety chip 22 in place in order to affix the fitting member 14 of FIG. 5 and without aperture 15A to the external sleeve 18. After the ferrule 16 has been aligned and disposed for registry with the hollow fitting member 12, as would be readily discernable to those artisans possessing the ordinary skill in the art, the external sleeve member 18 is screwed unto the hollow fitting member 12 to produce the embodiment of FIG. 5. Prior to the disposing the hollow fitting member 14 without the aperture 15A as indicated immediately above, the thermowell pipe plug member 30P may be inserted (e.g. threadably inserted) into and through the open end 30A of the thermowell member 30 to plug-off the same, as best shown in FIG. 4.

Another means or way f or plugging the thermowell assembly 11 in order that the thermowell member 30 does not communicate with the atmosphere, is the embodiment of the present invention shown in FIG. 17. In this embodiment, the same hollow fitting member 14 with aperture 15A is employed, along with the same bushing assembly 80. For this embodiment of the invention, the same hollow fitting member 14 of FIGS. 6 or 6A having aperture 15A is removed from the thermowell assembly 11 as immediately indicated above. The bushing cap member 92 with the aperture 98B (see FIG. 9) is removed off the bushing section 82 and is replaced with the bushing cap member 92 having the closed end 98A (see FIGS. 8 and 18). After such replacement, the same hollow fitting member 14 with aperture 15A and the same bushing assembly 80, but having the closed ended 98A cap member 92, is replaced with the assistance of the external sleeve 18 in order to produce the embodiment of the invention of FIG. 17. As apparent, with the use of the closed ended 98A cap member 92 the thermowell member 30 is again sealed-off or plugged-off from the atmosphere.

Figure 15:
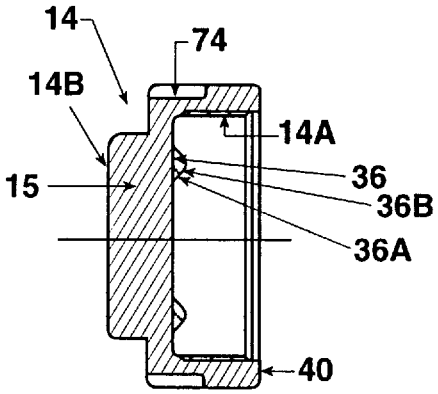
FIG. 15 is a sectional view of a sealing protective cap which atmospherically closes off a thermowell member in the event that the thermowell member begins to leak.
Figure 16:
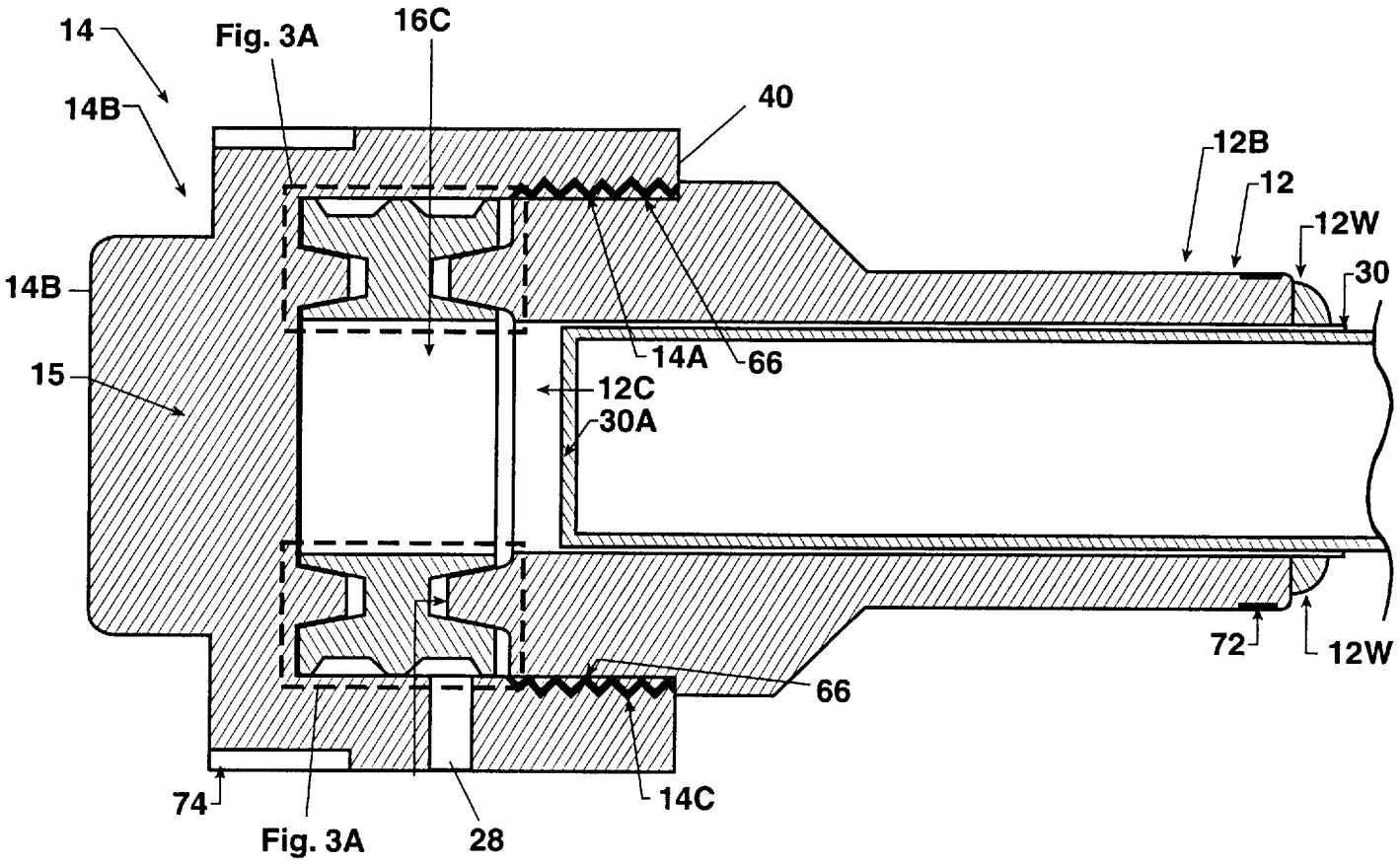
FIG. 16 is a partial sectional view of an embodiment of the present invention with the sealing protective cap of FIG. 15 threadably engaged to a generally hollow fitting member to encapsulate therein the ferrule member and to seal off a leaking thermowell member from the atmosphere.

And yet in another preferred embodiment of the present invention, the hollow fitting member 14/external sleeve 18 combination is replaced with the hollow fitting member 14 (i.e. a sealing protective cap) of FIG. 15 to produce the embodiment of the invention depicted in FIG. 16. In this embodiment, only the hollow fitting member 12 and optionally the ferrule 16, is employed along with the hollowing fitting member 14 shown in FIGS. 15 and 16. This procedure of the present invention also closes- off the leaking thermowell 30 from the atmosphere. The threads 14A threadably engage the threads 66 on the exterior of the fitting member 12 for hermetically sealing-off the leaking thermowell member 30 from the atmosphere. In the embodiment of the hollow fitting member 14 in FIG. 16, the fitting member 14 is provided with the parametric ridge 36 for engaging into in a sealably fashion the tapered channel 44 of the ferrule 16 (see FIG. 16 again).

In still yet another embodiment of the procedure in the present invention, the thermowell member 30 may be sealed-off from the atmosphere by merely severing the thermocouple member 32 (such as severing immediately outside the open end 30A of the thermowell member 30) and leaving the remaining severed portion of the thermocouple member 32 in the improved thermowell assembly 11. With the remaining severed part of the thermocouple member 32 lodged in the improved thermowell assembly 11, the thermowell assembly 11 may be plugged in accordance with any the previously discussed procedures such as that depicted in FIGS. 5, 15, 16, 17, 19, and 20. As previously indicated, the bushing assembly 80 may be disposed in the hollow fitting member 12 (see FIG. 20) and the plug-off or sealing of the thermowell assembly 11 may take place by merely removing the bushing cap member 92 having aperture 98B and replacing it with the bushing cap member 92 of FIG. 8 and 18 wherein no aperture 98B exists. Obviously, the hollow cap fitting 14 of FIG. 15 or the hollow cap fitting 14/ ferrule 16 of FIG. 16 may be employed along with the hollow fitting member 12 in FIG. 20.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A pipe union assembly comprising:

a generally hollow sleeve assembly having a first end with a tubular bore and a generally cup-shaped second end having a structure defining an end recess and a cylindrical opening communicating with the end recess and being generally axially aligned with the tubular bore of the first end of the generally hollow sleeve assembly;

a bushing assembly engaged in said second end recess of said generally cup-shaped second end of the sleeve assembly and having a bushing opening which is generally axially aligned with the cylindrical opening of the generally cup-shaped second end;

a cylindrical well member having a generally solid well end and a generally open well end, said generally open well end of said cylindrical well member being disposed in said tubular bore of the first end of the generally hollow sleeve assembly;

a generally cylindrical shaped member passing through said cylindrical opening of said generally cup-shaped second end, through said bushing opening, and through said generally open well end of said cylindrical well member and into the cylindrical well member;

wherein said bushing assembly comprises:

a bushing body having a bushing body bore and a bushing body recess and engaged in said end recess of said generally cup-shaped second end of the generally hollow sleeve assembly such as to produce a protruding bushing body section extending away from said end recess;

a bushing sealing member having a bushing sealing opening and disposed in said bushing body recess of said bushing body;

a bushing cap member having a bushing cap aperture and engaged to said protruding bushing body section of said bushing body; and said bushing body bore, said bushing sealing opening, and said bushing cap aperture all being generally axially aligned to essentially form said bushing opening of said bushing assembly.

2. A thermowell assembly comprising:

a generally hollow sleeve assembly having a first end with a tubular bore and a generally cup-shaped second end having a structure defining an end recess and a cylindrical opening communicating with the end recess and being generally axially aligned with the tubular bore of the first end of the generally hollow sleeve assembly;

a bushing assembly engaged in said end recess of said generally cup-shaped second end of the sleeve assembly and having a bushing opening which is generally axially aligned with the cylindrical opening of the generally cup-shaped second end;

a generally cylindrically shaped thermowell member having a generally solid thermowell end and a generally thermowell open end disposed in said tubular bore of said first end of said generally hollow sleeve assembly; and a thermocouple member passing through said cylindrical opening of said generally cup-shaped second end, through said bushing opening, and through said generally thermowell open end of said thermowell member and into the thermowell member;

wherein said bushing assembly comprises:

a bushing body having a bushing body bore and a bushing body recess and engaged in said end recess of said generally cup-shaped second end of the generally hollow sleeve assembly such as to produce a protruding bushing body section extending away from said end recess;

a bushing sealing member having a bushing sealing opening and disposed in said bushing body recess of said bushing body;

a bushing cap member having a bushing cap aperture and engaged to said protruding bushing body section of said bushing body; and said bushing body bore, said bushing sealing opening, and said bushing cap aperture all being generally axially aligned to essentially form said bushing opening of said bushing assembly.

3. The pipe union assembly of claim 1 wherein said generally hollow sleeve assembly comprises:

a generally hollow first fitting member having a first fitting bore terminating in a first annular tapered ridge;

a ferrule sealing member having a ferrule opening and a ferrule structure including a first annular tapered channel and a second annular tapered channel, said first annular tapered channel of said ferrule structure receiving and lodging said first annular tapered ridge of said generally hollow first fitting member;

a second fitting member at least partially defined by said generally cup-shaped second end and including a second annular tapered ridge which lodges in said second annular tapered channel of said ferrule structure of said ferrule sealing member; and an outside sleeve member engaged to said generally hollow first fitting member and to said second fitting member and encapsulating said ferrule sealing member.

4. The pipe union assembly of claim 3 wherein said protruding bushing body section extends and protrudes in a direction towards said cylindrical well member.

5. The pipe union assembly of claim 4 wherein said generally cylindrical shaped member extends and protrudes away from said generally cup-shaped second end in a direction opposite to the direction that said protruding bushing body section extends and protrudes.

6. The thermowell assembly of claim 2 wherein said generally hollow sleeve assembly comprises:

a generally hollow first fitting member having a first fitting bore terminating in a first annular tapered ridge;

a ferrule sealing member having a ferrule opening and a ferrule structure including a first annular tapered channel and a second annular tapered channel, said first annular tapered channel of said ferrule structure receiving and lodging said first annular tapered ridge of said generally hollow first fitting member;

a second fitting member at least partially defined by said generally cup-shaped second end and including a second annular tapered ridge which lodges in said second annular tapered channel of said ferrule structure of said ferrule sealing member; and an outside sleeve member engaged to said generally hollow first fitting member and to said second fitting member and encapsulating said ferrule sealing member.

7. The thermowell assembly of claim 6 wherein said protruding bushing body section extends and protrudes in a direction towards said cylindrically shaped thermowell member.

8. The thermowell assembly of claim 7 wherein said thermocouple member extends and protrudes away from said generally cup-shaped second end in a direction opposite to the direction that said protruding bushing body section extends and protrudes.

9. The thermowell assembly of claim 1 additionally comprising:

a reactor for hydroprocessing a hydrocarbon feed stream, said reactor having a generally cylindrical reactor wall containing a hydroconversion reaction zone having a bed of catalyst wherethrough a hydrocarbon feed stream flows; and said generally hollow sleeve assembly being supported by said generally cylindrical reactor wall of said reactor such that said generally solid thermowell end extends into said hydroconversion reaction zone.

10. The thermowell assembly of claim 8 additionally comprising:

a reactor for hydroprocessing a hydrocarbon feed stream; said reactor having a generally cylindrical reactor wall containing a hydroconversion reaction zone having a bed of catalyst wherethrough a hydrocarbon feed stream flows; and said generally hollow sleeve assembly being supported by said generally cylindrical reactor wall of said reactor such that said generally solid thermowell end extends into said hydroconversion reaction zone.

* * * * *